US006368252B1

(12) United States Patent
Stearns

(10) Patent No.: US 6,368,252 B1
(45) Date of Patent: Apr. 9, 2002

(54) EXERCISE METHODS AND APPARATUS

(76) Inventor: Kenneth W. Stearns, 8009 Cedol, Houston, TX (US) 77055

( * ) Notice: Subject to any disclaimer, the term of this patent is extended or adjusted under 35 U.S.C. 154(b) by 0 days.

(21) Appl. No.: 09/664,666

(22) Filed: Sep. 19, 2000

Related U.S. Application Data

(63) Continuation of application No. 09/167,688, filed on Oct. 7, 1998, now Pat. No. 6,152,859.
(60) Provisional application No. 60/061,389, filed on Oct. 7, 1997.

(51) Int. Cl.[7] ..... A63B 22/60
(52) U.S. Cl. ..... 482/52; 482/51
(58) Field of Search ..... 482/51, 52, 53, 482/57, 62, 70, 79, 80, 148

(56) References Cited

U.S. PATENT DOCUMENTS 5,401,226 A * 3/1995 Stearns ..... 482/53
5,575,739 A * 11/1996 Piaget et al. ..... 482/51
5,971,892 A * 10/1999 Lee ..... 482/52
6,004,244 A * 12/1999 Simonson ..... 482/52
6,132,339 A * 10/2000 Wang et al. ..... 482/53
6,152,859 A * 11/2000 Stearns ..... 482/52

* cited by examiner

*Primary Examiner*—Stephen R. Crow

(57) ABSTRACT

An exercise apparatus has arm driven members and leg driven members which are movably mounted on a frame. In a first mode of operation, the arm driven members are movable relative to the frame and the leg driven members. In a second mode of operation, the arm driven members are linked to the leg driven members and movable together therewith relative to the frame. In a third mode of operation, the arm driven members are locked against movement relative to the frame in a manner which does not interfere with movement of the leg driven members. In a preferred embodiment, the leg driven members are movable in two generally orthogonal directions relative to the frame. The leg driven members may also be interconnected to move in reciprocal fashion in either and/or both of those directions, and/or supported in a manner that provides progressive resistance to downward movement as a function of downward travel.

4 Claims, 21 Drawing Sheets

FIG. 9
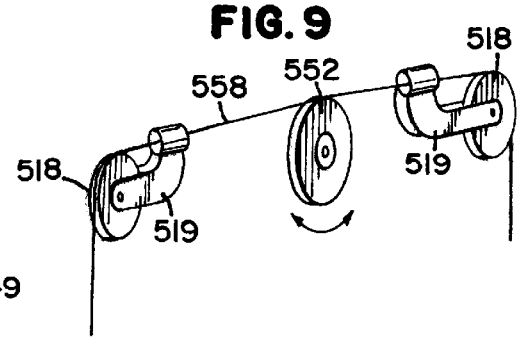
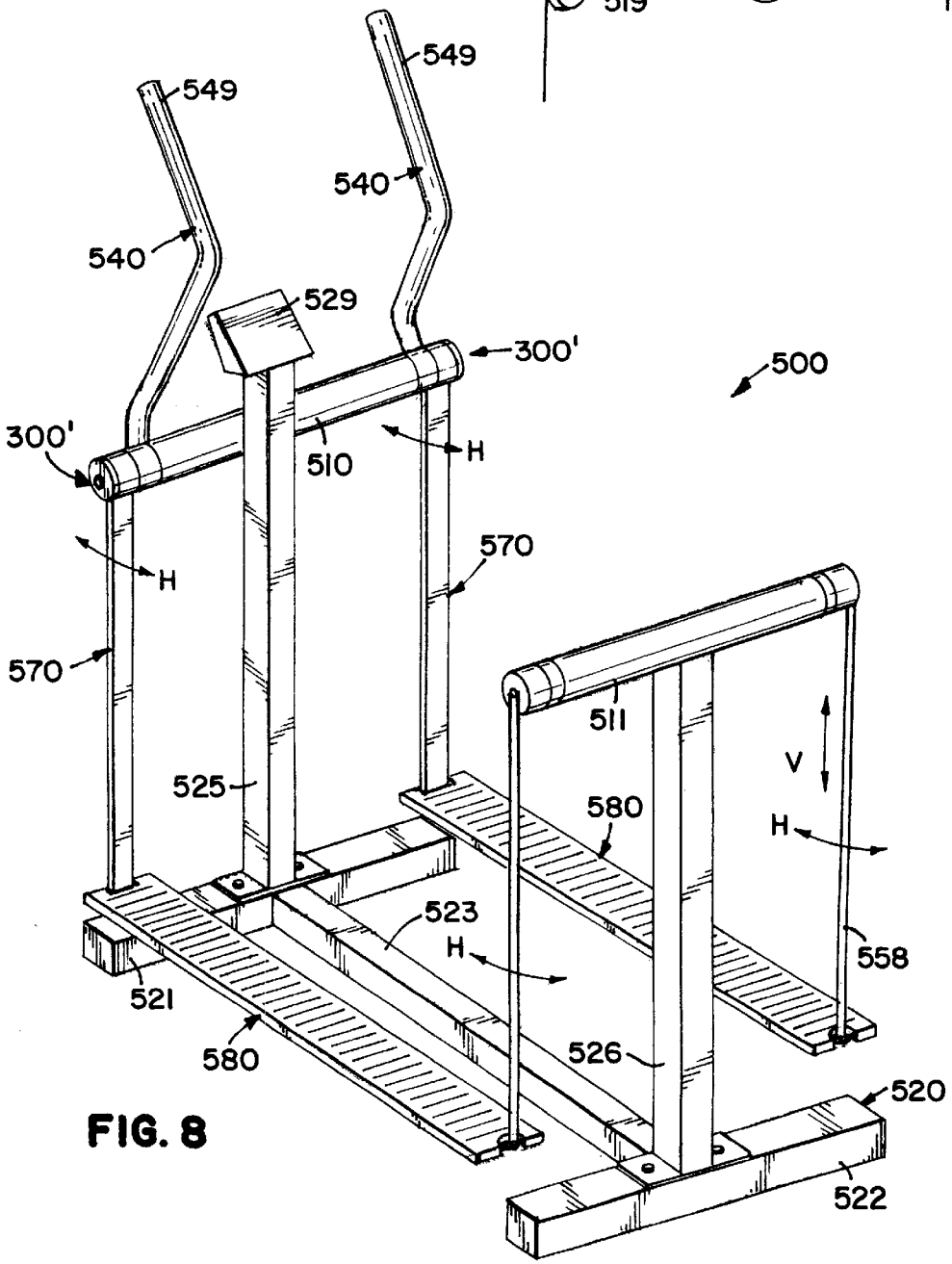
FIG. 8

FIG.14
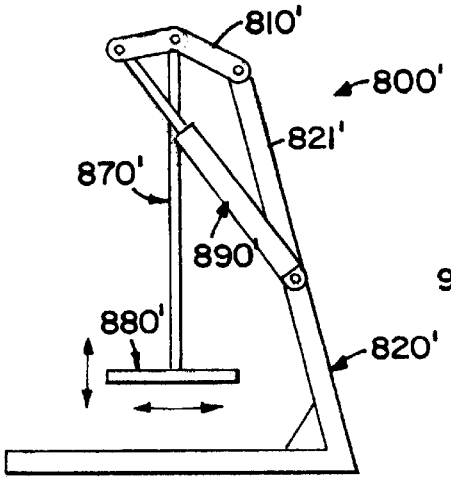
FIG.15
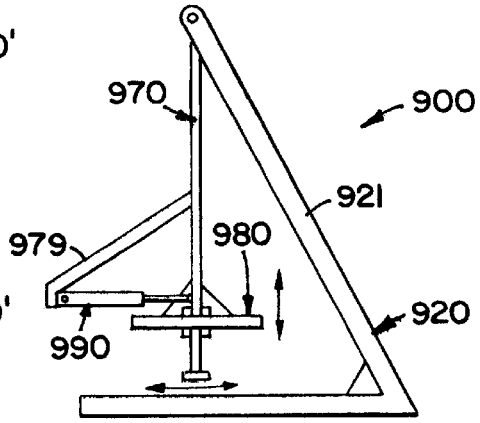
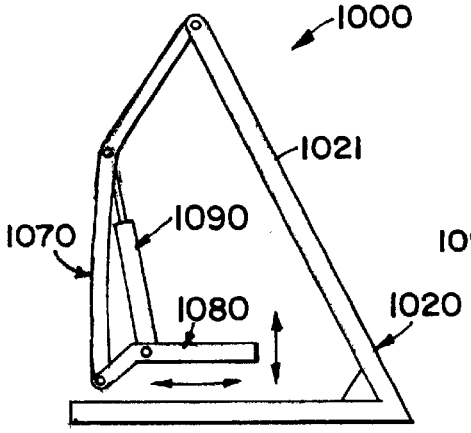
FIG.16
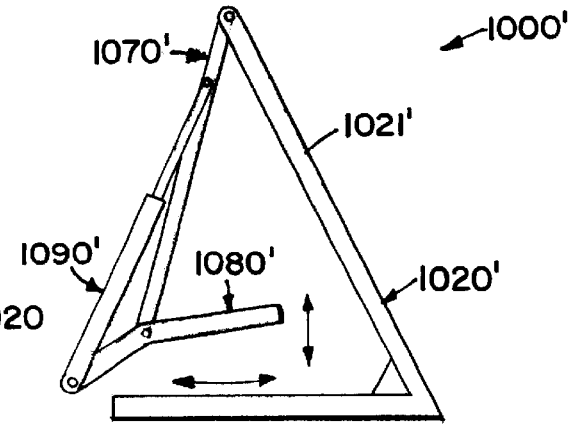
FIG.17

FIG. 18
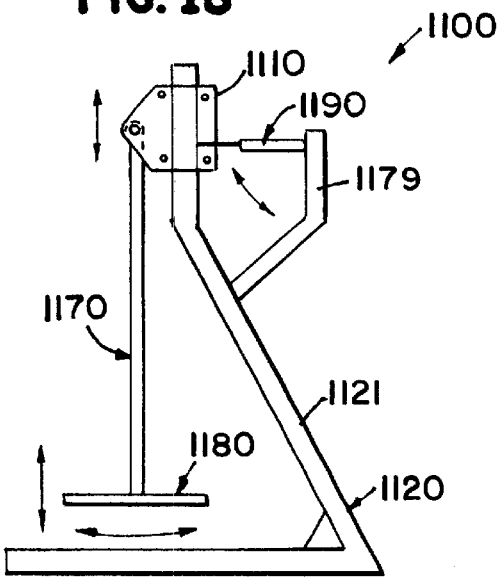
FIG. 19
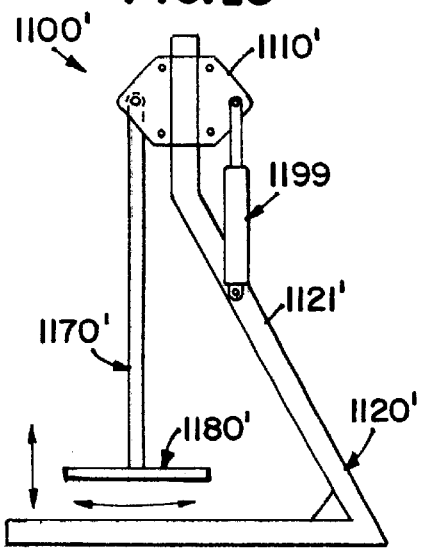
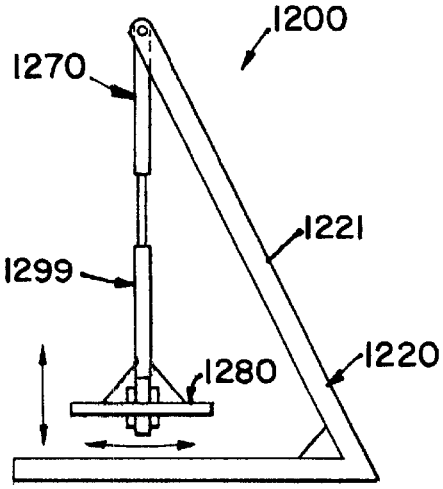
FIG. 20

EXERCISE METHODS AND APPARATUS

CROSS-REFERENCE TO RELATED APPLICATION

This application is a continuation of U.S. patent application Ser. No. 09/167,688, filed on Oct. 7, 1998, now U.S. Pat. No. 6,152,859 which is incorporated herein by reference, and which, in turn, discloses subject matter entitled to the filing date of U.S. Provisional Application Ser. No. 60/061,389, filed on Oct. 7, 1997.

FIELD OF THE INVENTION

The present invention relates to exercise methods and apparatus and more particularly, to exercise equipment which offers both upper body and lower body exercise.

BACKGROUND OF THE INVENTION

Exercise equipment has been designed to facilitate a variety of lower body exercise motions. For example, treadmills allow a person to walk or run in place; stepper machines allow a person to climb in place; bicycle machines allow a person to pedal in place; other machines allow a person to skate and/or stride in place; and still other machines guide a person's feet through elliptical paths of travel. Yet another exercise apparatus, disclosed in U.S. Pat. No. 5,290,211 to Stearns, is designed to facilitate several different exercise motions, including free form paths of foot movement and controlled paths of foot movement comparable to walking, running, stepping, cycling, striding, skiing, and/or elliptical motion.

Exercise equipment has also been designed to facilitate upper body exercise together with lower body exercise. For example, many of the foregoing types of exercise equipment have been provided with reciprocating cables or pivoting arm poles to facilitate contemporaneous upper body and lower body exercise. However, room for improvement remains.

SUMMARY OF THE INVENTION

Among other things, the present invention may be seen to provide an exercise assembly having a first type of exercise member and a second type of exercise member movably mounted on a frame. In a first mode of operation, each type of exercise member is independently movable relative to the frame. In a second mode of operation, the two types of exercise members are linked to move together relative to the frame. In a third mode of operation, one type of exercise member is locked to the frame to provide a rigid support during movement of the other type of exercise member.

In a preferred embodiment, the first type of exercise member is a handle, and the second type of exercise member is a foot support. The two exercise members are linked, either directly or indirectly, to discrete members which rotate about a common axis relative to the frame. In the absence of any supplemental interconnection, the hand driven member and the foot driven member move independently relative to the frame. The interconnection of a pin between the hand driven member and the foot driven member constrains the two members to rotate together relative to the frame. The interconnection of the pin between the hand driven member and the frame locks the hand driven member against rotation relative to the frame.

In another respect, the present invention may be seen to provide exercise methods and apparatus involving foot movement through a free form path of motion. In general, a foot supporting member is movably mounted on an intermediate member which, in turn, is movably mounted on a frame. As a result, the foot supporting member is free to move in two generally orthogonal directions relative to the frame. The freedom of foot movement notwithstanding, such apparatus may be fitted with tri-modal arm exercise assemblies like those discussed above. Moreover, the foot supporting members may be connected or selectively connected to move in reciprocating fashion relative to one another in either and/or both directions. The foot supporting members may also be supported in such a manner that resistance to downward travel becomes progressively greater as a function of downward movement. Many advantages and improvements of the present invention may become apparent from the more detailed description that follows.

BRIEF DESCRIPTION OF THE DRAWING

With reference to the Figures of the Drawing, wherein like numerals represent like parts throughout the several views.

FIG. 8 is a perspective view of an exercise apparatus provided with a tri-modal exercise assembly similar to that of FIGS. 5–6;

FIG. 9 is a perspective view of a cable routing assembly present on the exercise apparatus of FIG. 8;

FIG. 14 is a side view of an exercise apparatus similar in some respects to that of FIG. 13;

FIG. 15 is a side view of an exercise apparatus similar in some respects to that of FIG. 13;

FIG. 16 is a side view of an exercise apparatus similar in some respects to that of FIG. 13;

FIG. 17 is a side view of an exercise apparatus similar in some respects to that of FIG. 13;

FIG. 18 is a side view of an exercise apparatus similar in some respects to that of FIG. 13;

FIG. 19 is a side view of an exercise apparatus similar in some respects to that of FIG. 13;

FIG. 20 is a side view of an exercise apparatus similar in some respects to that of FIG. 13;

DESCRIPTION OF THE DEPICTED EMBODIMENT

The present invention facilitates three different modes of exercise involving a first exercise member and a second exercise member, each of which is movably mounted on a frame. In a first mode of operation, the first member is locked to the frame, and the second member is free to move relative to both the frame and the first member. In a second mode of operation, the first member is locked to the second member, and the linked members are free to move together relative to the frame. In a third mode of operation, the first member is not locked to either the frame or the second member, and the first member and the second member are free to move relative to the frame and one another. Those skilled in the art will recognize that the present invention is suitable for use on a wide range of exercise equipment.

Figure 1:
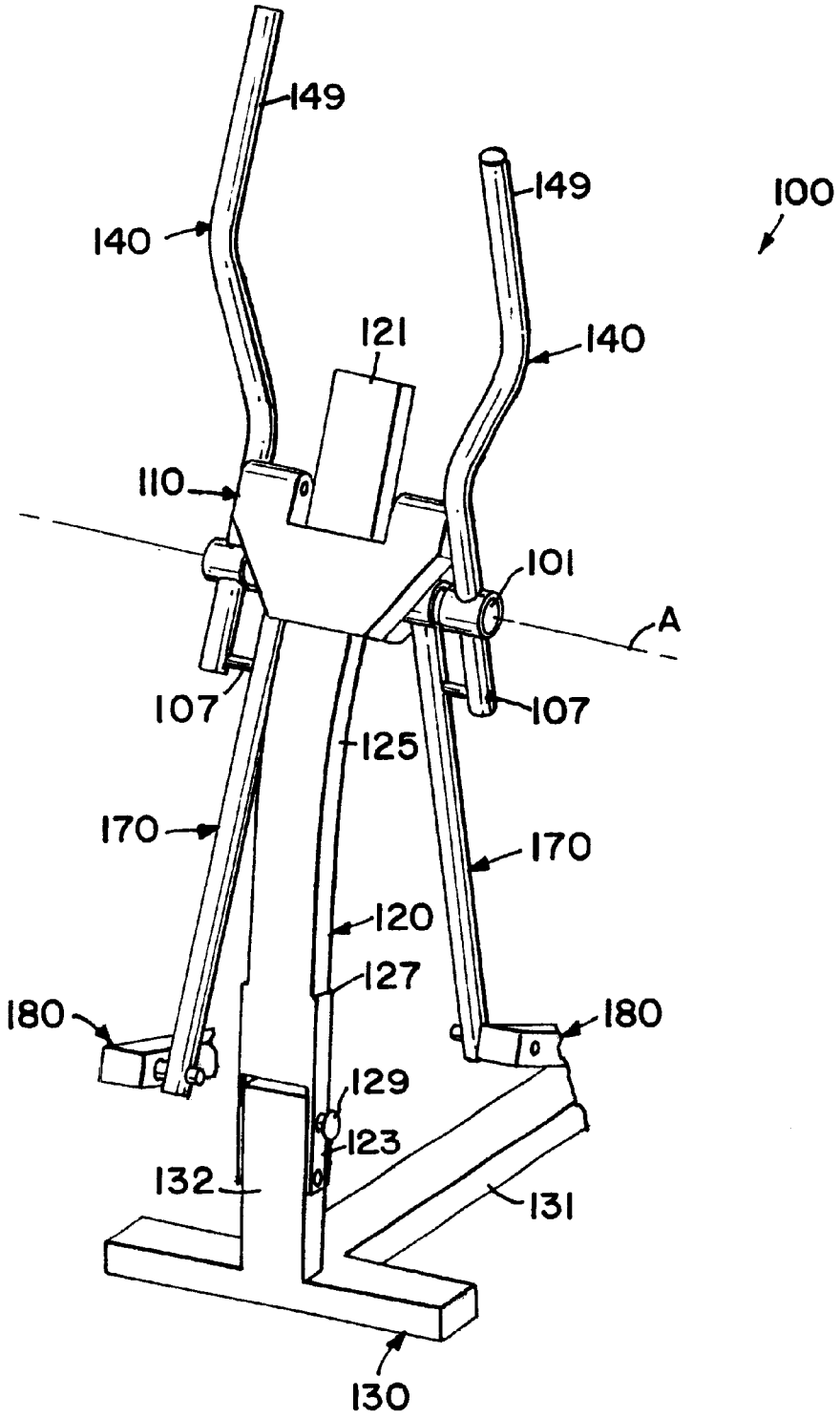
FIG. 1 is a partially fragmented, perspective view of a tri-modal exercise assembly constructed according to the principles of the present invention.
Figure 2:
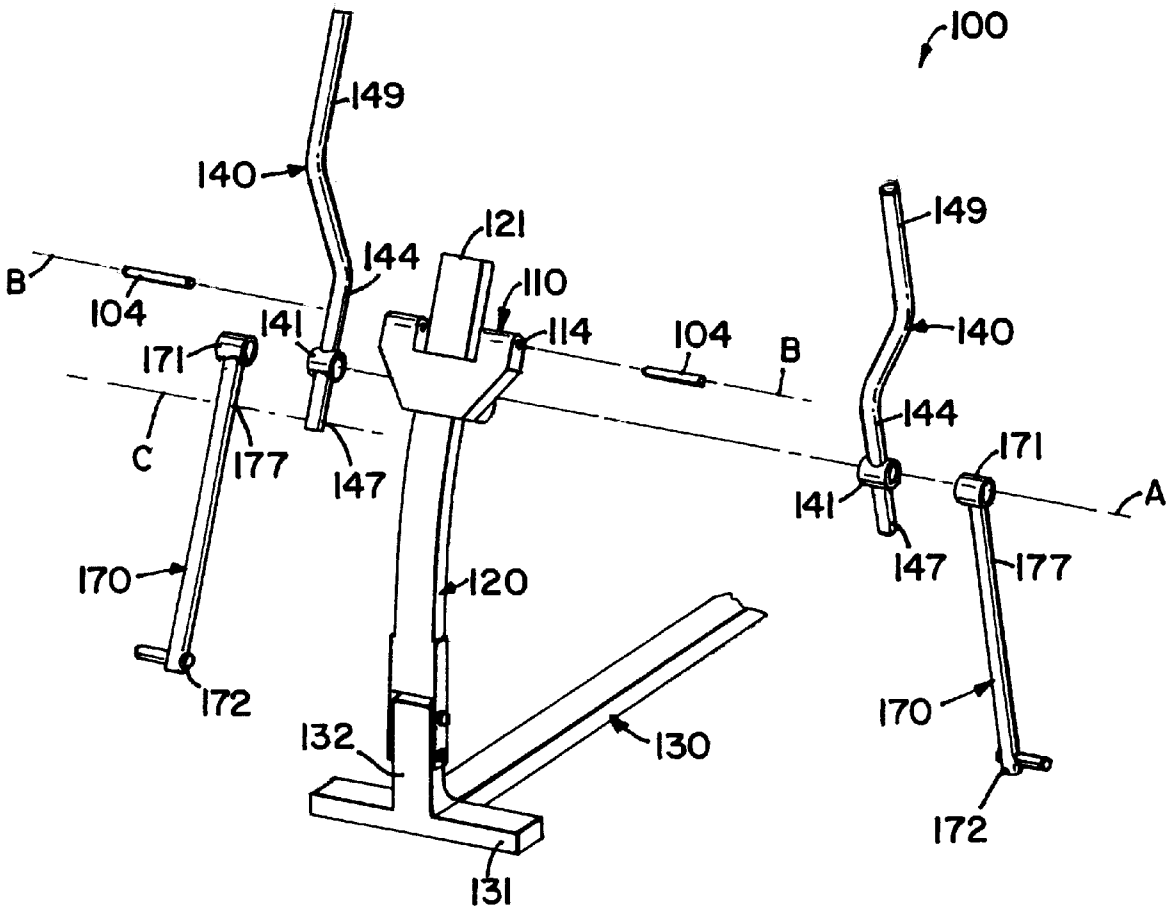
FIG. 2 is an exploded and partially fragmented, perspective view of the exercise assembly of FIG. 1.

One embodiment of the present invention is designated as 100 FIGS. 1–2. In general, the exercise assembly 100 includes a frame member 110, two arm driven members 140, and two leg driven members 170. The apparatus 100 is generally symmetrical about a vertical plane extending through center of the frame member 110 (between the two arm driven members 140 and between the two leg driven members 170), the only exceptions being the relative orientation of certain parts on opposite sides of the plane of symmetry. In view of this arrangement, like reference numerals are used to designate both the "right-hand" and "left-hand" parts on the apparatus 100, and in general, when reference is made to one or more parts on only one side of the apparatus, it is to be understood that corresponding part(s) are disposed on the opposite side of the apparatus 100. Moreover, the portions of the apparatus 100 which are intersected by the plane of symmetry exist individually and thus, do not have any "opposite side" counterparts.

As shown in FIG. 1, a shaft 101 is rigidly secured to the frame member 110 and protrudes beyond opposite sides thereof. The leg driven members 170 are movably mounted on opposite ends of the shaft 101 and are rotatable relative thereto about an axis A. The arm driven members 140 are also movably mounted on opposite sides of the shaft 101 and are rotatable relative thereto about the axis A.

In the absence of any additional interconnections, the arm driven members 140 and the leg driven members 170 are free to rotate relative to the frame member 110 and one another. In FIG. 1, pins 107 are shown interconnected between respective arm driven members 140 and leg driven members 170. As a result of this additional interconnection, the arm members 140 are constrained to rotate together with the leg driven members 170 relative to the frame member 110. In other words, the pins 107 may be said to be selectively interconnected between respective arm driven members 140 and leg driven members 170, and/or to provide a means for selectively linking the arm driven members 140 and the leg driven members 170. Moreover, the pins 107 may be seen to cooperate with the leg driven members 170 to provide a means for selectively linking the arm driven members and the foot supporting members 180.

In the alternative, pins 104 may be interconnected between respective arm driven members 140 and the frame member 110, in which case, the arm driven members 140 are locked in place relative to the frame member 110, and the leg driven members 170 are free to rotate relative to both the frame member 110 and the arm driven members 170. In other words, the pins 104 may be seen to provide a means for selectively locking the arm driven members 140 to the frame member 110. In view of the foregoing, the apparatus 100 may be seen to provide the options of stationary arm supports, independent arm and leg exercise movements, and dependent arm and leg exercise movements.

For purposes of clarity, the preferred embodiment 100 is shown and described with reference to discrete sets of pins 104 and 107. However, the holes may all be made of like diameter, and a single, common set of pins may be provided in lieu of separate pins 104 and 107, thereby reducing the cost of manufacturing the apparatus 100 and/or ensuring that the arm driven members 140 are not simultaneously connected to both the leg driven members 170 and the frame member 110.

A collar 141 is provided on a first portion of each of the arm driven members 140 to facilitate connection to the shaft 101. A hole 144 is formed through a second portion of each of the arm driven members 140 to align with a respective hole 114 in the frame member 110. Each of the holes 144 and 114 is sized and configured to receive one of the pins 104. A hole 147 is formed through a third portion of each of the arm driven members 140 to align with a hole 177 in a respective leg driven member 170. Each of the holes 147 and 177 is sized and configured to receive one of the pins 107. A handle 149, sized and configured to be grasped in a person's hand, is provided on a fourth portion of each of the arm driven members 140. In this embodiment 100, the fourth portion coincides with the upper end of each arm driven member 140; the third portion coincides with the lower end of each arm driven member 140; and the first and second portions are disposed therebetween (with the holes 144 and 147 disposed on opposite sides of the collar 141).

As noted above, a hole 177 is formed through a first portion of each leg driven member 170 to align with a hole 147 in a respective arm driven member 140. A collar 171 is provided on a second portion of each of leg driven member 170 to facilitate connection to the shaft 101. A foot support 180, sized and configured to support a person's foot, is connected to a third portion 172 of each leg driven member 170. In this embodiment 100, the third portion 172 coincides with the lower end of each leg driven member 170; the second portion coincides with the upper end of each leg driven member 170; and the first portions is disposed therebetween. Although the foot supports 180 are shown rotatably connected to respective leg driven members 170, those skilled in the art will recognize that various types of foot supports and foot supporting assemblies may be connected to the leg driven members 170 without departing from the scope of the present invention.

Those skilled in the art will recognize that the holes 144 and 114 are disposed an equal distance from the axis A, and that the holes 147 and the holes 177 are also disposed an equal distance from the axis A. Those skilled in the art will also recognize that the distance between the holes 144 and the axis A need not be equal to the distance between the holes 147 and the axis A. Furthermore, with reference to the arm driven member 140 on the right side of the apparatus 100, the hole 144 has a longitudinal axis B, and the hole 147 has a longitudinal axis C. Since the portion of the arm driven member 140 extending between the hole 144 and the hole 147 is linear, a reference line may be drawn transversely through all three of the axes A, B, and C.

In the embodiment 100, the frame member 110 is slidably mounted on a post 120 which, in turn, is pivotally mounted on a base 130. The base 130 includes a floor engaging portion 131 and a forward stanchion or upright 132. A lower end 123 of the post 120 is rotatably mounted to the stanchion 132 in a manner known in the art. A pin 129 or other suitable fastener (such as a snap button, for example) is interconnected between the stanchion 132 and the lower end 123 of the post 120 to lock the latter in an upright position relative to the former. Removal of the pin 129 allows the post 120 to be collapsed or pivoted to an orientation approximately parallel to the floor engaging portion 131 of the base 130 for storage or transportation purposes.

The frame member 110 slides along an intermediate portion 125 of the post 120 between an upper distal end 121 and a pair of shoulders 127 projecting outwardly from the post 120 proximate the lower end 123. Any of several types of adjustable locking systems may be used to selectively lock the frame member 110 in one of several positions along the post 120. For example, a spring-loaded pin 136 may extend through the frame member 110 and into engagement with any of a plurality of holes in the post 120. In the alternative, a lead screw or simple motor may be interconnected between the frame member 110 and the post 120 and operable to move the former up and down relative to the latter and hold it in place. In any event, the inclination of the path traveled by the force receiving members 180 is a function of the height of the frame member 110 above the floor surface. In other words, the difficulty of exercise can be increased simply by locking the frame member 110 in a relatively higher position on the post 120.

Figure 3:
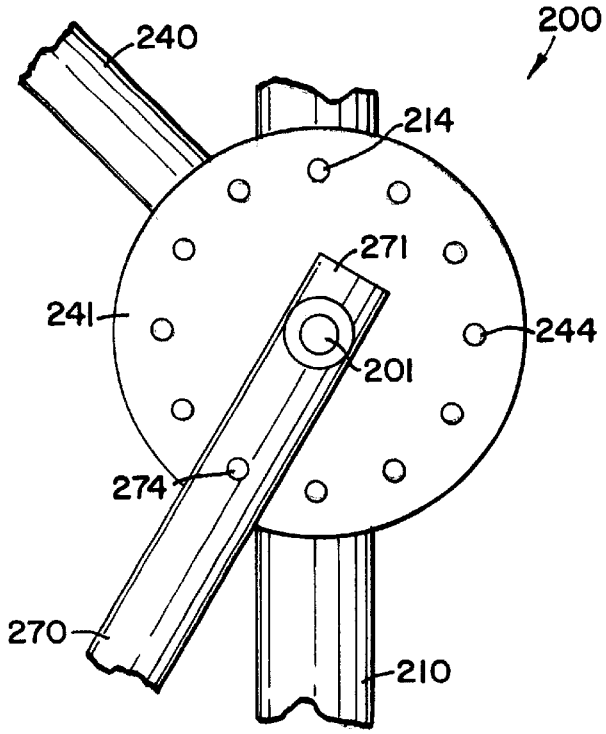
FIG. 3 is a fragmented side view of another tri-modal exercise assembly constructed according to the principles of the present invention.
Figure 4:
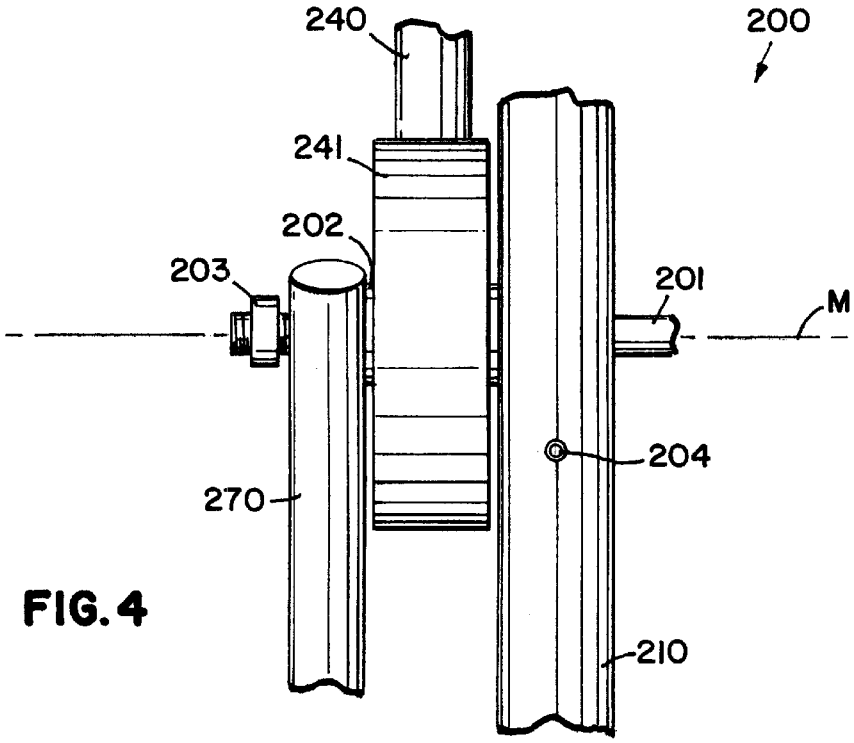
FIG. 4 is a fragmented front view of the exercise assembly of FIG. 3.

A second embodiment of the present invention is designated as 200 in FIGS. 3–4. Like the first embodiment 100, this second exercise assembly 200 facilitates three different modes of exercise as between the upper body and the lower body. The assembly 200 is described with reference to only a single arm driven member 240 and a single leg driven member 270.

A shaft 201 is rigidly connected to a frame member 210 which occupies a fixed position relative to a floor surface or other stable support. A lower end 241 of the arm driven member 240 is cylindrical in shape and has a hole extending through the center thereof to receive an end of the shaft 201. With bearings or washers 202 disposed on opposite sides thereof, the lower end 241 of the arm driven member 240 is placed on an end of the shaft 201. A hole is formed through an upper end 271 of the leg driven member 270 to similarly receive the end of the shaft 201. The upper end 271 of the leg driven member 270 is subsequently placed on the end of the shaft 201 and is retained thereon by a nut 203, for example. As a result, the arm driven member 240 and the leg driven member 270 are rotatable about an axis M relative to the frame member 210.

Circumferentially spaced holes 244 extend through the lower end 241 of the arm driven member 240 and selectively align with a hole 214 through the frame member 210 and a hole 274 through the leg driven member 270. A pin 204 is sized and configured to be inserted through any aligned pair of holes to lock the arm driven member 240 to either the frame member 210 or the leg driven member 270. In FIG. 4, the pin 204 is shown occupying a storage position, inserted through another hole in the frame member 210. The multiple holes 244 allow the arm driven member 240 to be selectively locked in any of several orientations relative to either the frame member 210 or the leg driven member 270.

In a first mode of operation or configuration, the pin 204 is stored as shown in FIG. 4, so that the leg driven member 270 is free to pivot independent of the arm driven member 240, and the arm driven member 240 is free to pivot independent of the leg driven member 270. As a result, a person may grasp the upper end of the arm driven member 240 and selectively or independently move same during lower body exercise. In a second mode of operation or configuration, the pin 204 is inserted through one of the holes 244 and the hole 214, so that the arm driven member 240 is locked to the frame member 210, but the leg driven member 270 remains free to pivot independent of the arm driven member 240. As a result, a person may grasp the stationary arm driven member 240 for support during lower body exercise. In a third mode of operation or configuration, the pin 204 is inserted through the hole 274 and one of the holes 244, so that the arm driven member 240 is locked to the leg driven member 270, and the interconnected members 240 and 270 are free to pivot together relative to the frame member 210. With movement of the leg driven member 270 linked to movement of the arm driven member 240, a person may, during lower body exercise, grasp the arm driven member 240 and choose to simply allow the arm driven member 240 to follow the prescribed path of motion, or help drive the arm driven member 240 through the prescribed path of motion, or provide resistance to movement of the arm driven member 240 through the prescribed path of motion.

Figure 5:
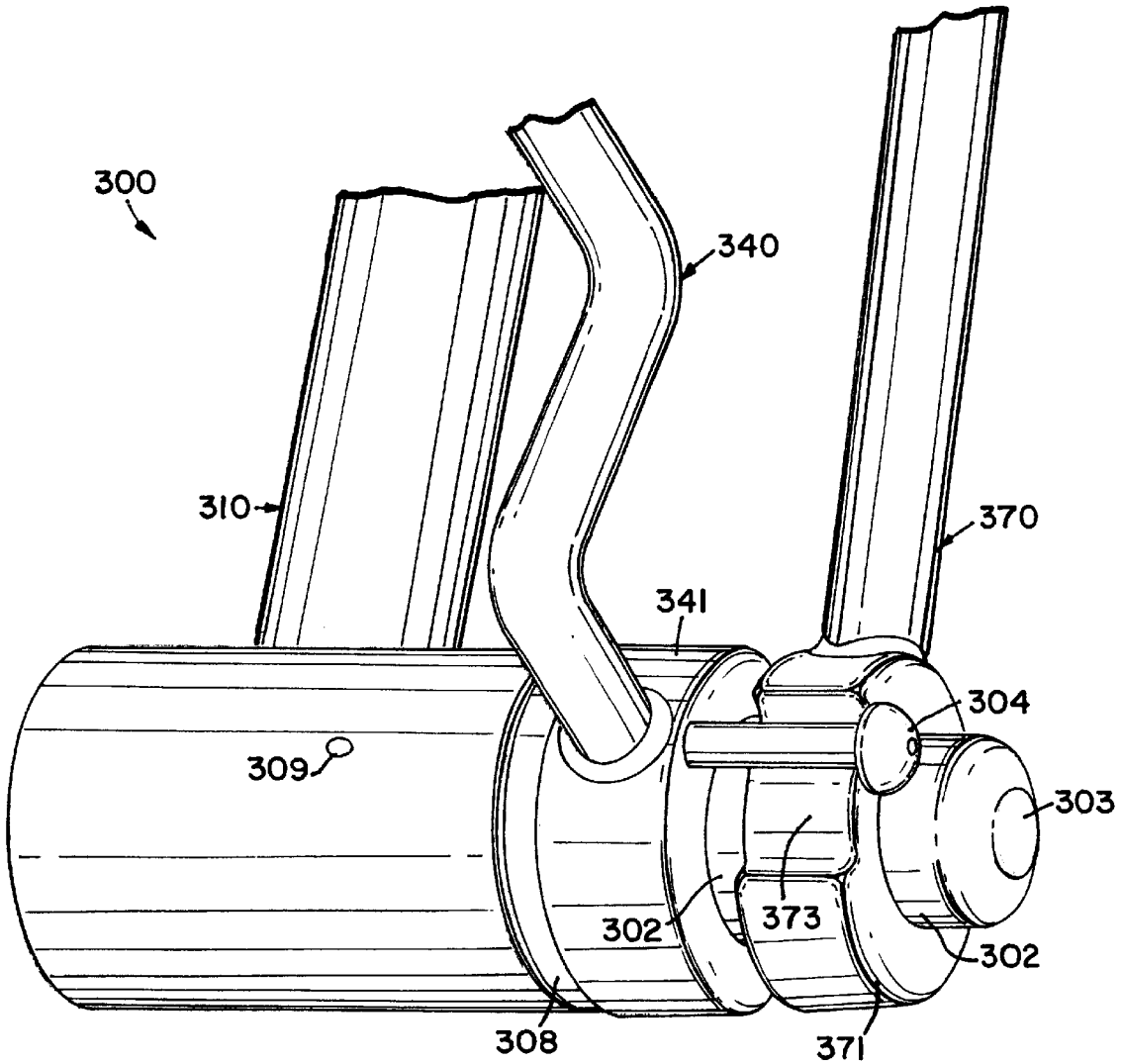
FIG. 5 is a fragmented, perspective view of yet another tri-modal exercise assembly constructed according to the principles of the present invention.
Figure 6:
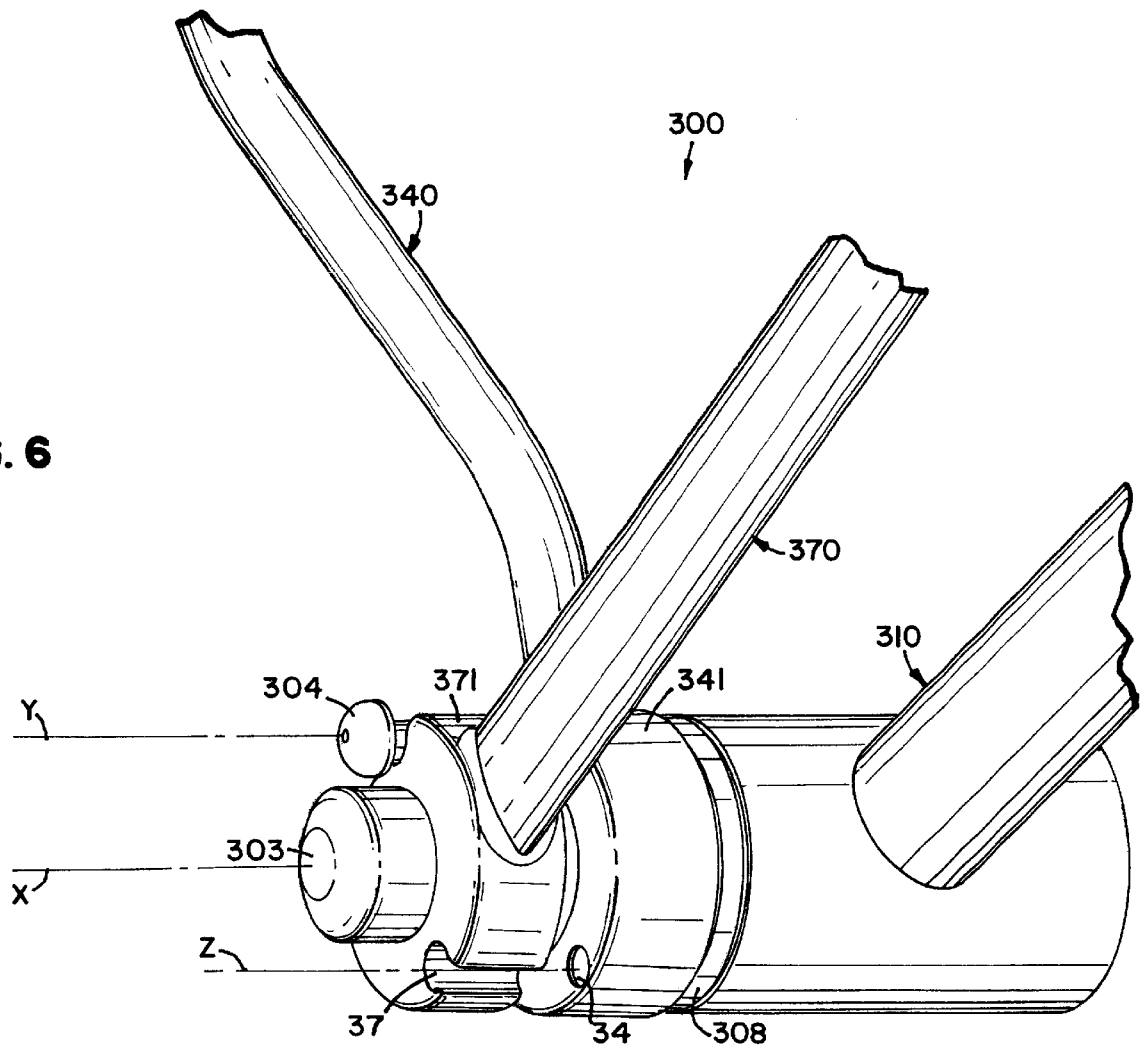
FIG. 6 is another fragmented, perspective view of the exercise assembly of FIG. 5.

A third embodiment of the present invention is designated as 300 in FIGS. 5–6. Like the two previous embodiments 100 and 200, this third exercise assembly 300 facilitates three different modes of exercise as between the upper body and the lower body. Again, the assembly 300 is described with reference to only a single arm driven member 340 and a single leg driven member 370.

The assembly 300 includes a shaft (not shown) which projects outwardly from a frame member 310. An end 341 of the arm driven member 340 is cylindrical in shape and has a hole formed through its center to accommodate the shaft. Similarly, an end 371 of the leg driven member 370 is cylindrical in shape and has a hole formed through its center to accommodate the shaft. The end 341 of the arm driven member 340 is rotatably mounted on the shaft with a friction disc 308 disposed between bearing surfaces on the end 341 and the frame 310. The end 371 of the leg driven member 370 is rotatably mounted on the shaft with a thrust bearing 302 disposed between the end 371 and the end 341. A knob 303 is threaded onto the end of the shaft with another thrust bearing 302 disposed between the knob and the end 371 of the leg driven member 370. The knob 303, the leg driven member 370, and the arm driven member 340 rotate about an axis X relative to the frame member 310.

The knob 303 cooperates with the frame member 310 to compress the thrust bearings 302, the ends 371 and 341, and the friction disc 308 therebetween. Rotation of the knob 303 in a first direction increases compression of the intermediate components, and rotation of the knob 303 in a second, opposite direction decreases compression of the intermediate components. The thrust bearings 302 tend to isolate the leg driven member 370 from the frictional resistance effect of the friction disc 308. In other words, resistance to pivoting of the arm driven member 340 may be provided independent of resistance to pivoting of the leg driven member 370. Those skilled in the art will recognize that other arrangements or resistance devices may be used without departing from the scope of the present invention.

A pin 304 is sized and configured to be inserted through a hole in the end 341 and an aligned hole in the frame 310 to lock the arm driven member 340 against rotation relative to the frame 310. As shown in FIGS. 5-6, the aligned holes define an axis Y. A cavity or depression 373 is formed in a sector about the end 371 to provide clearance for rotation of the leg driven member 370 relative to the frame 310 and the pin 304. In this configuration or mode of operation, the arm driven member 340 provides a stationary handle during lower body exercise.

The pin 304 may alternatively be inserted through a groove 377 in the end 371 and into another aligned hole 347 in the end 341 to lock the arm driven member 340 to the leg driven member 370 so that they rotate together relative to the frame 410. The aligned hole 347 and groove 377 define an axis Z which is co-planar with the axes X and Y. In this configuration or mode of operation, the arm driven member 340 and the leg driven member 370 are movable in dependent fashion relative to the frame member 310, and the resistance provided by the friction disc 308 acts upon the leg driven member 370, as well as the arm driven member 340. The length of the pin 304 is such that it protrudes further beyond the end 371 when occupying the hole 347.

The pin 304 may alternatively be removed entirely from the arm driven member 340 and inserted into a storage hole 309 on the frame member 310. In this configuration or mode of operation, the arm driven member 340 and the leg driven member are movable in independent fashion relative to the frame member 310, and the resistance provided by the friction disc 308 acts only upon the arm driven member 340.

Those skilled in the art will recognize that various types of lower body exercise or leg motions may be linked to the tri-modal exercise assemblies of the present invention. For example, a foot support may be rigidly connected to an opposite end of the leg driven member; or a pedal may be rotatably connected to an opposite end of the leg driven member; or a foot support may be movably interconnected between an opposite end of the leg driven member and a discrete portion of the frame; or a foot support may be movably interconnected between an opposite end of the leg driven member and one or more additional members which are supported by the frame.

Figure 7:
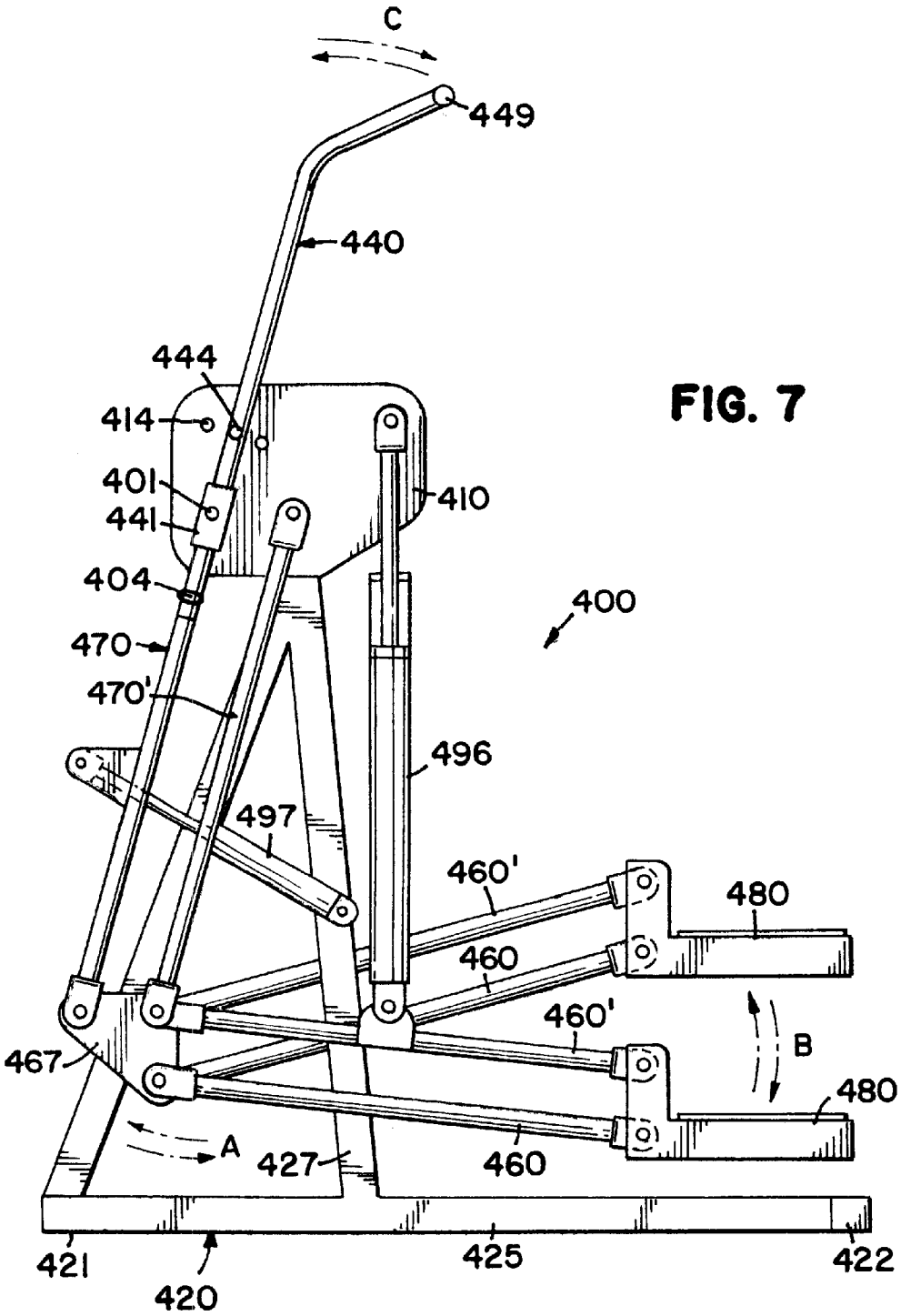
FIG. 7 is a side view of an exercise apparatus provided with a tri-modal exercise assembly similar to that of FIGS. 1–2.

An exercise machine constructed according to the principles of the present invention is designated as 400 in FIG. 7. The leg exercising portion of this machine 400 is similar to that shown in U.S. Pat. No. 5,290,211 to Stearns, which patent is incorporated herein by reference to same. In general, the machine 400 includes a frame 420, arm driven members 440, and a leg exercise assemblies.

The frame 420 includes a generally I-shaped base designed to rest upon a horizontal floor surface. The base includes a forward transverse support 421, a rearward transverse support 422, and an intermediate portion 425 extending therebetween. An inverted, generally V-shaped upright 427 extends upward from the base proximate the forward end thereof, and a bracket or frame member 410 is mounted on top of the upright 427. Those skilled in the art will recognize that some sort of input and/or output device may also be mounted on the upright 427 to provide an interface between the machine 400 and a person using the machine.

Each leg exercise assembly includes a first leg driven member 470 which is movably connected to the frame member 410 and free to move relative thereto in a first direction within a vertical plane, and a second leg driven member 460 which is movably connected to the first leg driven member 470 and free to move relative thereto in a second, generally orthogonal direction within the same vertical plane. In the embodiment 400 shown in FIG. 7, each first leg driven member 470 is rotatably connected to the frame member 410 and rotatable relative thereto in the direction of the arrows A (within the plane of the drawing sheet of FIG. 7), and each second leg driven member 460 is rotatably connected to the first leg driven member 470 and rotatable relative thereto in the direction of the arrows B (also within the plane of the drawing sheet of FIG. 7).

A foot support 480 is connected to a rearward end of the second leg driven member 460. In this embodiment 400, a parallel set of leg driven members 460' and 470' is similarly interconnected between the frame member 410 and the foot support 480 to provide a toggle mechanism which allows the foot support 480 to remain parallel to the floor surface throughout its range of motion. In particular, a lower end of each of the first leg driven members 470 and 470' is rotatably connected to a bracket 467, and a forward end of each of the second leg driven members 460 and 460' is rotatably connected to the bracket 467. A resistance mechanism, in the form of a hydraulic cylinder 496, is rotatably interconnected between the second leg driven member 460' and the frame member 410 to resist downward movement of the former relative to the latter. A resistance mechanism, in the form of a hydraulic cylinder 497, is rotatably interconnected between the first leg driven member 470 and the frame upright 427 to resist rearward movement of the former relative to the latter.

Each arm driven member 440 is movably connected to the frame member 410 and free to move relative thereto in a first direction within a vertical plane. In the embodiment 400 shown in FIG. 7, an intermediate portion 441 of each arm driven member 440 is rotatably connected to the frame member 410 and rotatable relative thereto in the direction of the arrows C (within the plane of the drawing sheet of FIG. 7). In particular, both the arm driven members 440 and the first leg driven members 470 rotate about a common shaft 401 which is rigidly secured to the frame member 410. An upper, distal end 449 of each arm driven member 440 extends perpendicular to the plane of the drawing sheet of FIG. 7 and provides a handle suitable for grasping by a person standing on the foot supports 480.

A pin 404 is selectively inserted through aligned holes in overlapping portions of the arm driven member 440 and the first leg driven member 470 to lock the two members 440 and 470 together. In this configuration, shown in FIG. 7, forward and rearward movement of either foot support 480 is linked to rearward and forward pivoting of a respective handle 449. In the alternative, the pin 404 may be selectively inserted through aligned holes in the arm driven member 440 and the frame member 410 to lock the arm driven member 440 against rotation relative to the frame member 410. In this configuration, the foot supports 480 are free to move forward and rearward independent of the arm driven members 470. Several holes 414 are provided in the frame member 410, in an arc centered about the shaft 401, to alternatively align with the holes 444 through the arm driven members 440 and thereby facilitate adjustment of the handles 449 relative to a user standing on the foot supports 480. In a third configuration, the pin 404 may be removed from the arm driven member 440 altogether, leaving the arm driven member 440 and the leg driven member 470 free to move relative to one another and the frame member 410. Those skilled in the art will recognize that any of the features associated with any of the embodiments 100, 200, or 300 could be provided and/or substituted for those shown on the machine 400.

Another exercise machine constructed according to the principles of the present invention is designated as 500 in FIG. 8. In general, the machine 500 includes a frame 520, arm exercise members 540, and leg exercise members 580.

The frame 520 includes a generally I-shaped base designed to rest upon a horizontal floor surface. The base includes a forward transverse support 521, a rearward transverse support 522, and an intermediate portion 523 extending therebetween. A first or forward upright 525 extends upward from the base proximate the forward end thereof, and a second or rearward upright 526 extends upward from the base proximate the rearward end thereof. An assembly 529 is mounted on an upper end of the upright 525 to provide an interface between the machine 500 and a person using the machine. A forward support member 510 is mounted on the forward upright 525 and extends generally perpendicular relative thereto. A rearward support member 511 is mounted on the rearward upright 526 and extends generally perpendicular relative thereto and generally parallel to the forward support member 510.

Each arm exercise member 540 is movably connected to a respective end of the support member 510 and movable relative thereto in a first direction within a vertical plane. In the embodiment 500 shown in FIG. 8, a lower end of each arm exercise member 540 is rotatably connected to the support member 510. An optional friction disc is disposed between the lower end and the support member 510 to provide resistance to rotation. An opposite, upper end 549 is sized and configured for grasping.

Each leg exercise member 580 has a forward end which is rotatably connected to a lower end of a link or leg driven member 570. An opposite, upper end of each leg driven member 570 is rotatably connected to a respective end of the support member 510. In particular, both the leg driven members 570 and the arm driven members 540 rotate about a common shaft or axis which is rigidly secured to the support member 510. As suggested by the reference numerals 300', the arm driven members 540 may be selectively pinned to the frame 520; or the arm driven members 540 may be selectively pinned to the leg driven members 570; or the arm driven members 540 may remain free to move relative to both the frame 520 and the leg driven members 570.

Each leg exercise member or foot support 580 has an opposite, rearward end which is movably connected to a respective end of a cable 558. The cable 558 extends upward from the rearward end of the left foot support 580 to the left end of the support member 511, then through the support member 511 to the right end thereof, and then downward to the rearward end of the right foot support 580. A guide assembly, including a pulley 518 and a sleeve 519, is mounted to each end of the support member 511 to route the cable 558 and facilitate movement thereof relative to the support member 511. As a result of this arrangement, the rearward ends of the foot supports 580 are linked to move up and down in reciprocal fashion (as suggested by the arrow V). As shown in FIG. 9, resistance to "climbing-type" motion may be provided by placing a friction brake 552 in series with the cable 558, for example.

The foot supports 580 are also movable back and forth relative to the frame 520 (as suggested by the arrows H). Resistance to this "striding-type" motion may be provided by interconnecting the leg driven members 570 and the arm driven members 540 and thereby subjecting the former to the friction discs acting upon the latter. In the absence of a tri-modal exercise assembly 300', resistance may be provided simply by interconnecting a friction brake directly between the frame 520 and each of the leg driven members 570. On an alternative embodiment along these lines, arm driven members may simply be provided in the form of extensions of the leg driven members, and/or stationary handles may be provided on the support member.

Figure 10:
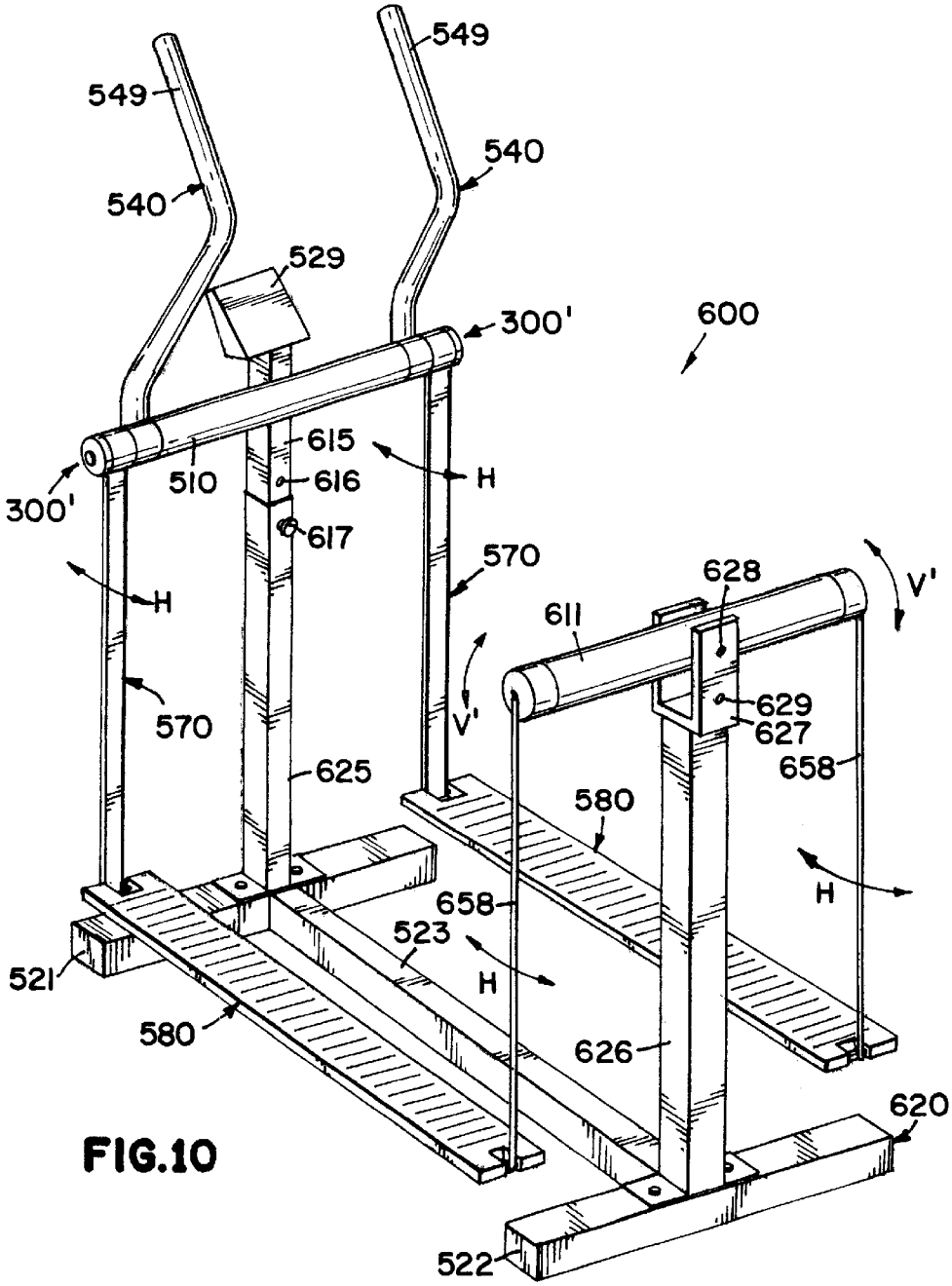
FIG. 10 is a perspective view of another exercise apparatus provided with a tri-modal exercise assembly similar to that of FIGS. 5–6.

An exercise machine similar in many respects to the previous embodiment 500 is designated as 600 in FIG. 10. In general, the machine 600 includes a frame 620, arm exercise members 540, and leg exercise members 580.

The frame 620 includes a generally I-shaped base which is identical to that on the previous embodiment 500. A first or forward upright 625 extends upward from the base proximate the forward end 521 thereof, and a second or rearward upright 626 extends upward from the base proximate the rearward end 522 thereof.

A post 615 is connected to the forward upright 625 and selectively movable relative thereto in telescoping fashion. A pin 617 is inserted through a hole in the upright 625 selectively aligns with any of several holes 616 in the post 615 to secure the latter in place relative to the former. Those skilled in the art will recognize that other adjustment mechanisms, such as a lead screw, could be substituted for the pin arrangement shown. An assembly 529 is mounted on an upper end of the post 615 to provide an interface between the machine 600 and a person using the machine.

A forward support member 510 is mounted on the post 615 and extends generally perpendicular relative thereto. Those skilled in the art will recognize that elevation adjustment of the support member 510 may alternatively be provided by movably mounting the support member 510 on the upright 525 of the previous embodiment 500.

A trunnion 627 is mounted on an upper end of the upright 626, and a rearward support member 611 is rotatably mounted on the trunnion 627. The support member 611 is rotatably about an axis 628 which extends parallel to the intermediate portion 523 of the base. When the machine 600 is not in use, the support member 611 extends generally perpendicular relative to the upright 626 and generally parallel to the forward support member 510.

As on the previous embodiment 500, each arm exercise member 540 has a lower end which is rotatably connected to a respective end of the support member 510, and an opposite, upper end 549 which is sized and configured for grasping. Each leg driven member has an upper end which is likewise rotatably connected to a respective end of the support member 510. The same tri-modal assembly 300' allows the arm driven members 540 to be selectively pinned to the support member 510; to be selectively pinned to the leg driven members 570; or to remain free to move relative to both the support member 510 and the leg driven members 570.

An opposite, lower end of each leg driven member 570 is rotatably connected to a forward end of a respective leg exercise member or foot support 580. An opposite, rearward end of each foot support 580 is movably connected to a lower end of a respective cable 658. Each cable 658 extends upward and is secured to a respective end of the support member 611. As a result of this arrangement, the rearward ends of the foot supports 580 are linked to move up and down in reciprocal fashion (as suggested by the arrows V'). The foot supports 580 are also movable back and forth relative to the frame 620 (as suggested by the arrows H).

Figure 11:
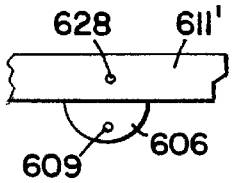
FIG. 11 is an end view (relative to the apparatus of FIG. 10 as a whole) of an alternative support member suitable for use on the apparatus of FIG. 10.

FIG. 11 shows an optional feature suitable for use on the embodiment 600. In particular, a flange 606 may be rigidly secured to the support member 611', and a hole 609 formed through the flange 606. The hole 609 aligns with a hole 629 through the trunnion 627 when the support member 611' is parallel to the floor surface. A detent pin may be inserted through the aligned holes to selectively lock the support member 611' against pivoting and thereby limiting movement of the foot supports 580 to a "striding-type" motion.

Those skilled in the art will recognize that the foot supports 580 can alternatively be limited to a "climbing-type" motion by interconnecting the leg driven members 570 to the arm driven members 540 and increasing resistance provided by the assemblies 300' to maximum. In other words, this embodiment 600 provides an exercise apparatus which allows a user to choose between a constrained "striding-type" motion, a constrained "climbing-type" motion, a free-form motion which may combine a "striding-type" motion and a "climbing-type" motion in any number of ways.

Figure 12:
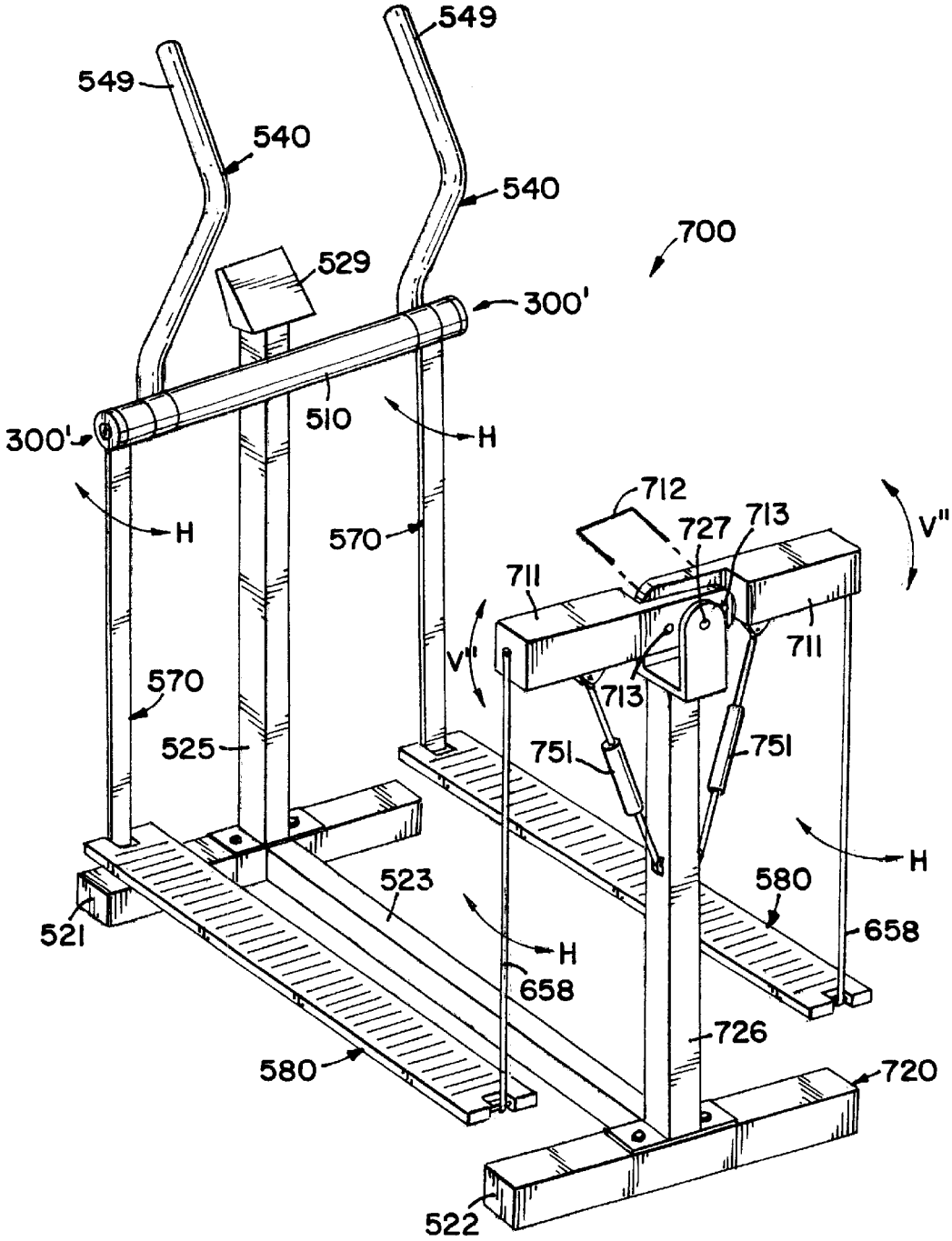
FIG. 12 is a perspective view of yet another exercise apparatus provided with a tri-modal exercise assembly similar to that of FIGS. 5–6.

Another exercise machine similar in many respects to the embodiment 500 is designated as 700 in FIG. 12. In general, the machine 700 includes a frame 720, arm exercise members 540, and leg exercise members 580.

The forward portion of the machine 700 (forward of a plane which intersects the intermediate portion 523 of the base and extends perpendicular relative thereto) is identical to that on the embodiment 500. On the rearward portion of the machine 700, an upright 726 extends upward from the base proximate the rearward end 522 thereof, and a trunnion 727 is mounted on an upper end of the upright 626. Left and right rearward support members 711 are mounted on the trunnion 727 and rotate relative thereto about an axis or shaft which extends parallel to the intermediate portion 523 of the base. Resistance cylinders 751 are interconnected between the upright 726 and respective support members 711 to resist pivoting of the latter relative to the former.

A rearward end of each foot support 580 is movably connected to a lower end of a respective cable 658. Each cable 658 extends upward and is secured to an outer end of a respective support member 711. In the absence of any further interconnections, such as U-shaped pin 712, the supports 711 are free to rotate relative to one another, as well as the upright 726. As a result, the rearward ends of the foot supports 580 are free to move up and down independent of one another. In this mode of operation, a spring or other return mechanism, which may be disposed within the cylinders 751, urges a respective foot support 580 upward in the absence of a user applied force.

Holes 713 extend through each support 711 on each side of the trunnion axis and align with one another to receive the U-shaped pin 712. In this mode of operation, the supports 711 are linked together, and the rearward ends of the foot supports 580 are constrained to move up and down in reciprocal fashion (as suggested by the arrows V"). The foot supports 580 are also movable back and forth relative to the frame 620 (as suggested by the arrows H).

Figure 13:
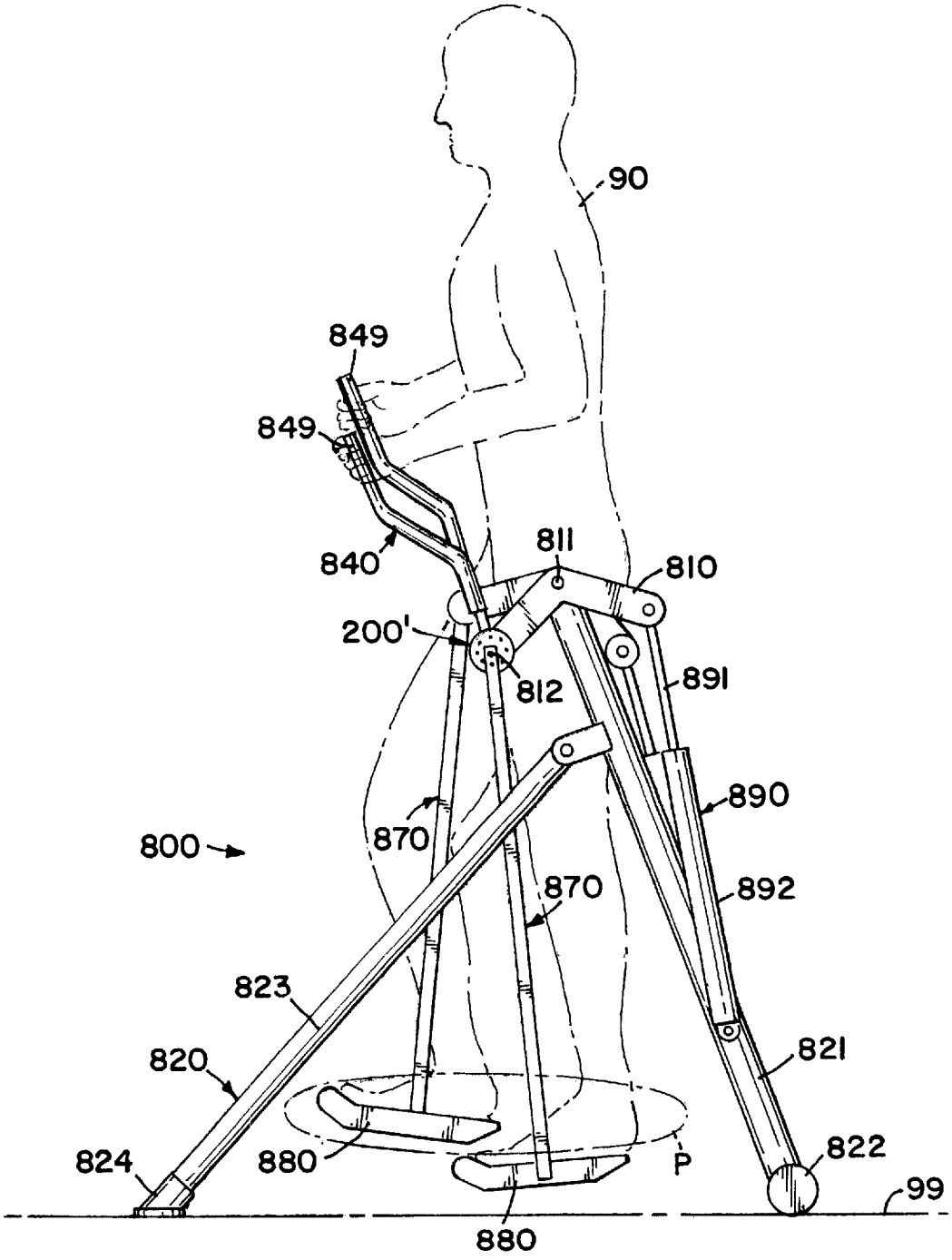
FIG. 13 is a side view of an exercise apparatus provided with a tri-modal exercise assembly similar to that of FIGS. 3–4.

Another exercise machine constructed according to the principles of the present invention is designated as 800 in FIG. 13. In general, the machine 800 includes a frame 820, arm driven members 840, and leg driven members 870.

The frame 820 includes rearward and forward U-shaped members which cooperate to maintain the apparatus 800 in an upright position relative to a horizontal floor surface 99. The rearward frame member includes a pair of posts 821 which extend perpendicularly away from opposite ends of a transverse support 822. The forward frame member includes a pair of posts 823 which extends perpendicularly away from opposite sides of a transverse support (not shown). Feet 824 are provided on the lower distal ends of the posts 823 to engage the floor surface 99 together with the rearward transverse support 822. The upper distal ends of the posts 823 are rotatably mounted to the rearward posts 821, proximate the upper ends of the latter. As a result, the posts 821 and 823 may be rotated together to facilitate storage and/or transportation of the apparatus 800.

Each of two rotating frame members 810 is generally L-shaped and has a relatively forward end or segment, a relatively rearward end or segment, and an intermediate portion or juncture disposed therebetween. The intermediate portion of each frame member 810 is rotatably mounted to a respective rearward post 821 at the upper distal end thereof. A lower end of each arm driven member 840 is rotatably connected to the forward end of a respective frame member 840. An opposite, upper end of each arm driven member 840 is sized and configured for grasping by a user 90.

An upper end of each leg driven member 870 is also rotatably connected to the forward end of a respective frame member 810 and shares a common pivot axis with a respective arm driven member 840. As suggested by the reference numeral 200', the rotating ends of the arm driven members 840 and the leg driven members 870 are similar to those shown in FIGS. 3–4. In other words, each arm driven member 840 may be pinned in any of several orientations relative to the frame 820, or may be pinned in any of several orientations relative to a respective leg driven member 870, or may remain free to pivot relative to both.

An opposite, lower end of each leg driven member 870 is joined to a respective foot platform or support 880 which is sized and configured to support a person's foot. Since each foot support 880 is pivotal about the axis 812, and the axis 812 is pivotal about the axis 811, each foot support 880 is movable through any sort of path within a respective vertical plane, subject to outer limits determined by the distance between the axes 811 and 812 and the distance between the axis 812 and the foot supports 880. One such path is designated as P in FIG. 13.

A constant force resistance mechanism 890 is interconnected between each rotating frame member 810 and a respective stationary frame member 821 to resist pivoting of the former relative to the latter. In particular, a rod portion 891 of the resistance mechanism 890 is rotatably connected to the rearward end of each rotating frame member 810, and a cylinder portion 892 of the resistance mechanism 890 is rotatably connected to a respective stationary frame member 821, relatively nearer the lower end thereof. A significant advantage of this particular arrangement is that the foot supports 880 are biased against "bottoming out" or moving downward to a lowermost position. In particular, as the rotating frame member 810 shown in FIG. 13 rotates counterclockwise, the vertical component of user applied force (or weight) acts upon a relatively shorter moment arm (relative to the axis 811), and the resistance force vector acts upon a relatively greater moment arm (relative to the axis 811). In other words, the apparatus 800 may be said to provide progressively increasing resistance to downward movement of the foot supports 880.

FIGS. 14–20 show additional examples of machines which provide progressively increasing resistance to downward movement of foot supports. Only one side of each machine is shown with the understanding that each moving part has a counterpart on the opposite side of the frame. Those skilled in the art will also recognize that any of these machines may be fitted with any of the tri-modal exercise assemblies shown in FIGS. 1–6 (simply by adding an arm driven member which shares a pivot axis with the leg driven member, for example), and further, that these machines, as well as the machines described above, do not require any such trimodal exercise assembly in order to be useful and suitable for exercise.

As shown in FIG. 14, an apparatus 800' has a frame 820' which includes a base and an upright member 821' extending up from the base. A rotating frame member 810' has a relatively rearward end, a relatively forward end, and an intermediate portion disposed therebetween. The rearward end is rotatably connected to the upper end of the upright member 821'. A constant force resistance mechanism 890 is rotatably interconnected between the forward end of the rotating frame member 810' and an intermediate portion of the upright member 821'. The intermediate portion of the rotating frame member 810' is rotatably connected to an upper end of a leg driven member 870'. A foot support 880' is connected to a lower end of the leg driven member 870'.

As shown in FIG. 15, an apparatus 900 has a frame 920 which includes a base and an upright member 921 extending up from the base. An upper end of a leg driven member 970 is rotatably connected to an upper end of the upright member 921. A foot support 980 is slidably mounted on the leg driven member 970 proximate its lower end. A constant force resistance mechanism 990 is rotatably interconnected between a bracket on the foot support 980 and a brace 979 on the leg driven member 970. The force resistance mechanism 990 extends generally horizontal when the leg driven member 970 extends generally vertical.

As shown in FIG. 16, an apparatus 1000 has a frame 1020 which includes a base and an upright member 1021 extending up from the base. An upper end of a leg driven member 1070 is rotatably connected to an upper end of the upright member 1021. A lower end of the leg driven member 1070 is rotatably connected to a forward end of a foot support 1080. A constant force resistance mechanism 1090 is rotatably interconnected between an intermediate portion of the foot support 1080 and an intermediate portion of the leg driven member 1070.

As shown in FIG. 17, an apparatus 1000' has a frame 1020' which includes a base and an upright member 1021' extending up from the base. An upper end of a leg driven member 1070' is rotatably connected to an upper end of the upright member 1021'. A lower end of the leg driven member 1070' is rotatably connected to an intermediate portion of a foot support 1080'. A constant force resistance mechanism 1090' is rotatably interconnected between a forward end of the foot support 1080' and an intermediate portion of the leg driven member 1070'. A rearward portion of the foot support 1080 is sized and configured to support a person's foot in cantilevered fashion.

As shown in FIG. 18, an apparatus 1100 has a frame 1120 which includes a base and an upright member 1121 extending up from the base. A bracket 1110 is slidably mounted on an upper, vertical portion of the upright 1121. An upper end of a leg driven member 1170 is rotatably connected to the bracket 1110. A foot support 1180 is rigidly secured to a lower end of the leg driven member 1170. A constant force resistance mechanism 1190 is rotatably interconnected between the bracket 1110 and an a brace 1179 rigidly secured to the upright 1121. The resistance mechanism 1190 extends horizontally when the bracket 1110 occupies an uppermost position along the upright 1121.

As shown in FIG. 19, an apparatus 1100' has a frame 1120' which includes a base and an upright member 1121' extending up from the base. A bracket 1110' is slidably mounted on an upper, vertical portion of the upright 1121'. An upper end of a leg driven member 1170' is rotatably connected to the bracket 1110'. A foot support 1180' is rigidly secured to a lower end of the leg driven member 1170'. A progressive force resistance mechanism 1199, which is known in the art, is rotatably interconnected between the bracket 1110' and an a brace 1179' rigidly secured to the upright 1121'. The resistance mechanism 1199 remains in a vertical orientation regardless of the position of the bracket 1110' relative to the upright 1121.

As shown in FIG. 20, an apparatus 1200 has a frame 1220 which includes a base and an upright member 1221 extending up from the base. An upper end of a leg driven member 1270 is rotatably connected to an upper end of the upright 1221. A progressive force resistance mechanism 1299 is rigidly interconnected between a lower end of the leg driven member and a foot support 1280. Those skilled in the art will recognize that the resistance mechanism 1299 could perform the function of the leg driven member 1270, as well. Those skilled in the art will also recognize that neither of the two foregoing embodiments requires a progressive force resistance mechanism in order to function satisfactorily as an exercise apparatus.

Figure 21:
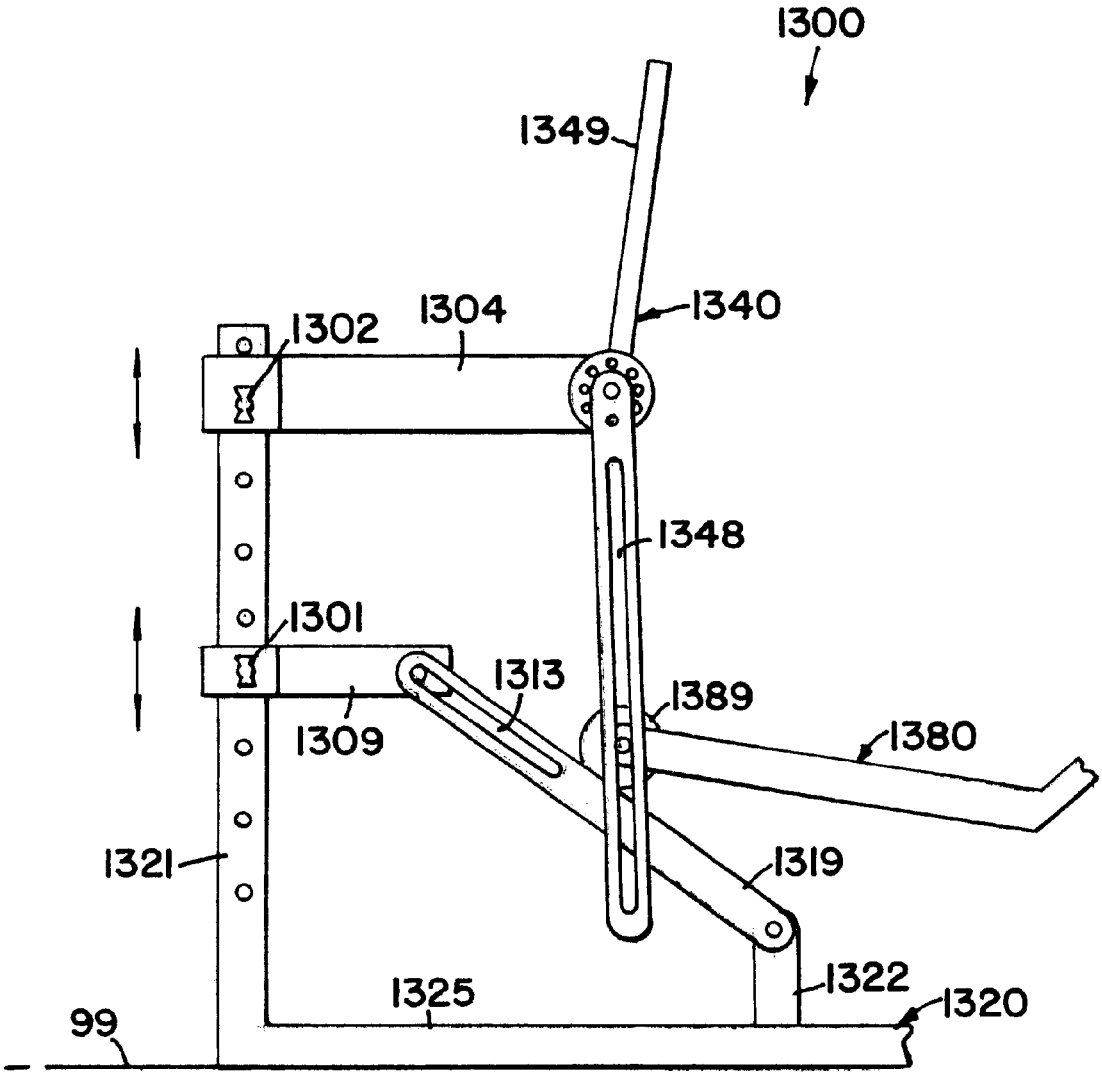
FIG. 21 is a side view of an exercise apparatus provided with a tri-modal exercise assembly similar to that of FIGS. 3–4.

As shown in FIG. 21, an exercise apparatus 1300 includes a frame 1320 having a base 1325 designed to rest upon a floor surface. A forward stanchion 1321 extends up from a forward portion of the base 1325, and an intermediate stanchion 1322 extending up from an intermediate portion of the base 1325. Not shown is a rearward portion of the base 1325, where a roller, crank, or other suitable assembly supports a rearward portion of a force receiving member or foot support 1380 in a manner known in the art.

A roller 1389 is rotatably mounted on a forward end of the force receiving member 1380. The roller 1389 rolls or bears against a ramp 1319 having a first end rotatably connected to the intermediate stanchion 1322, and a second, opposite end movably connected to a bracket 1309. A slot 1313 is provided in the ramp 1319 to accommodate angular adjustment of the ramp 1319 relative to the bracket 1309 and the floor surface 99. In particular, the trunnion 1309 is slidably mounted on the forward stanchion 1321, and a pin 1301 may be selectively inserted through aligned holes in the bracket 1309 and the stanchion 1321 to secured the bracket 1309 in any of several positions above the floor surface 99. As the bracket 1309 slides downward, the fastener interconnecting the bracket 1309 and the ramp 1319 moves downward, as well, and the ramp 1319 rotates counter-clockwise.

A lower portion of a handle member 1340 is movably connected to the forward end of the force receiving member 1380, adjacent the roller 1389. In particular, a common shaft extends through the force receiving member 1380, the roller 1389, and a slot 1348 provided in the lower portion of the handle member 1340. An opposite, upper end 1349 of the handle member 1340 is sized and configured for grasping by a person standing on the force receiving member 1380. An intermediate portion of the handle member 1340 is rotatably connected to a bracket 1304 which, in turn, is slidably mounted on the forward stanchion 1321 above the bracket 1309. A pin 1302 may be selectively inserted through aligned holes in the bracket 1304 and the stanchion 1321 to secure the bracket 1304 in any of several positions above the floor surface 99. The slot 1348 in the handle member 1340 accommodates height adjustments and allows the handle member 1340 to pivot about its connection with the bracket 1304 while the roller 1389 moves through a linear path of motion. As a result of this arrangement, the height of the handle member 1340 can be adjusted without affecting the path of the foot support 1380, and/or the path of the foot support 1380 can be adjusted without affecting the height of the handle member 1340, even though the two force receiving members are linked to one another. Some alternative elevation adjustment means are described below with reference to FIGS. 25–26.

Those skilled in the art will recognize that the handle member 1340 may be replaced by or separated into an arm driven member and a leg driven member which would share the same pivot axis as that currently defined by the handle member 1340. Subsequent to this simple modification, the machine 1300 could be equipped with any of the tri-modal exercise assemblies of FIGS. 1–6.

Figure 22:
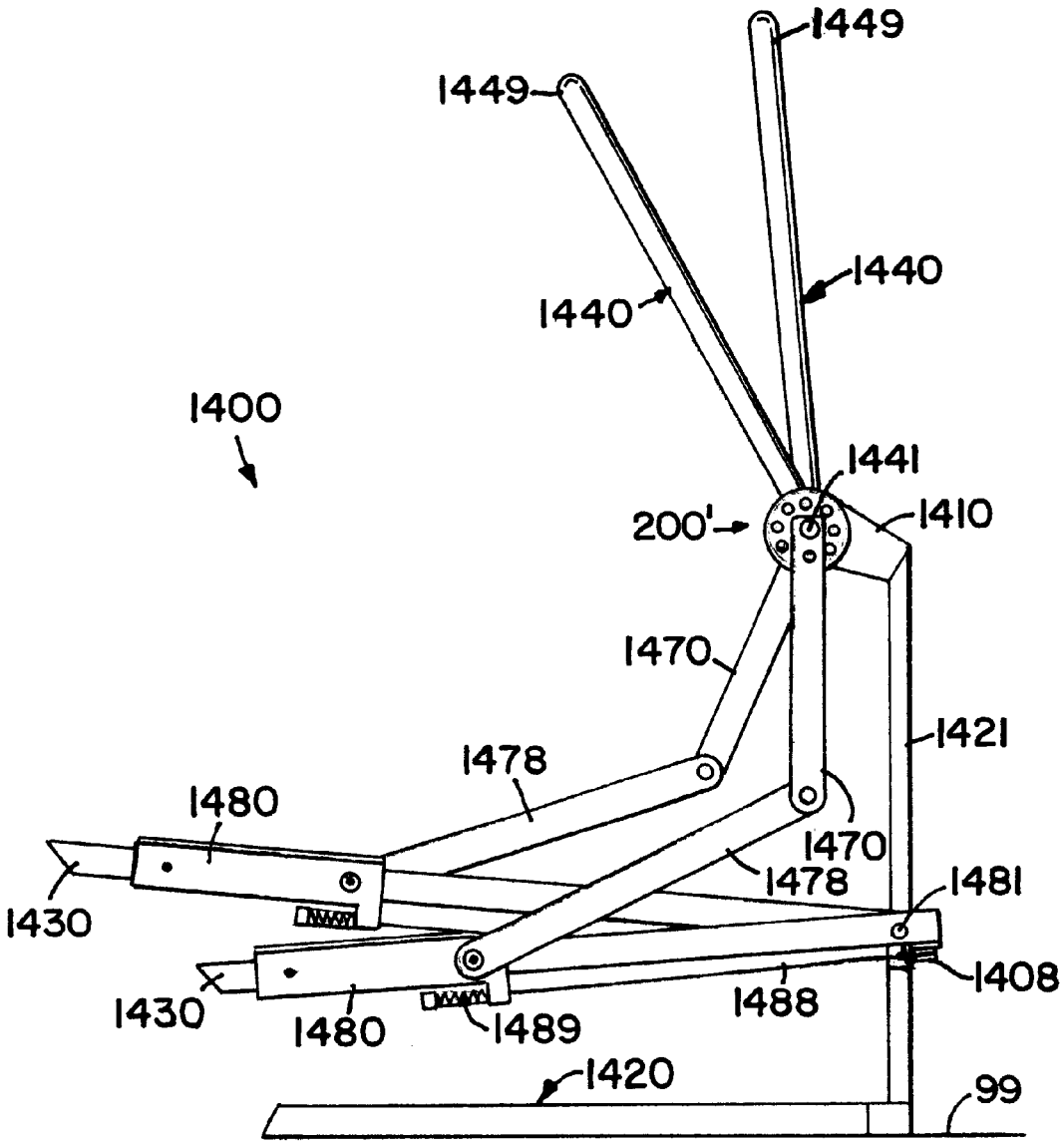
FIG. 22 is a side view of another exercise apparatus provided with a tri-modal exercise assembly similar to that of FIGS. 3–4.

FIG. 22 shows an exercise apparatus 1400 provided with a tri-modal exercise assembly 200' similar to that shown in FIGS. 3–4. The apparatus 1400 generally includes a frame 1420, arm exercise members 1440, and leg exercise members 1480. The assembly 200' allows the arm exercise members 1440 to be pinned in any of several orientations relative to the frame 1420, or to be pinned in any of several orientations relative to the leg exercise members 1480, or to remain free to move independent of both the frame 1420 and the leg exercise members 1480.

The frame 1420 includes a base portion designed to rest upon a floor surface 99 and an upright 1421 extending upward from the base portion proximate the front end thereof. A frame member or support 1410 is mounted to an upper end of the upright 1421 to support the tri-modal assembly 200'. Each arm exercise member or arm driven member 1440 has a lower end which is rotatably connected to the frame member 1410, and an opposite, upper end which is sized and configured for grasping.

Each of two rails 1430 has a front end which is pivotally mounted to the frame 1420 at a first elevation above the floor surface 99. The rails 1430 pivot about an axis 1481 relative to the frame 1420. The rearward portion of each rail 1430 may be supported by a force resistance cylinder, a roller, a crank, or any other suitable part. A foot support or skate 1480 is movably mounted on an intermediate portion of each rail 1430. The foot supports 1480 are interconnected by a cable 1488 which extends about a pulley 1408 rotatably mounted on the upright 1421. Springs 1480 are placed in series with the cable 1488 to keep the cable 1488 taut while also allowing sufficient freedom of movement during operation.

Each of two intermediate links 1478 is rotatably interconnected between a respective foot support 1480 and a respective leg driven member 1470. An opposite end of each of the leg driven members 1470 is rotatably connected to the frame member 1410. The leg driven members 1470 pivot about the same axis 1441 as the arm driven members 1440, primarily in conjunction with movement of the foot supports 1480 relative to the rails 1430.

Figure 23:
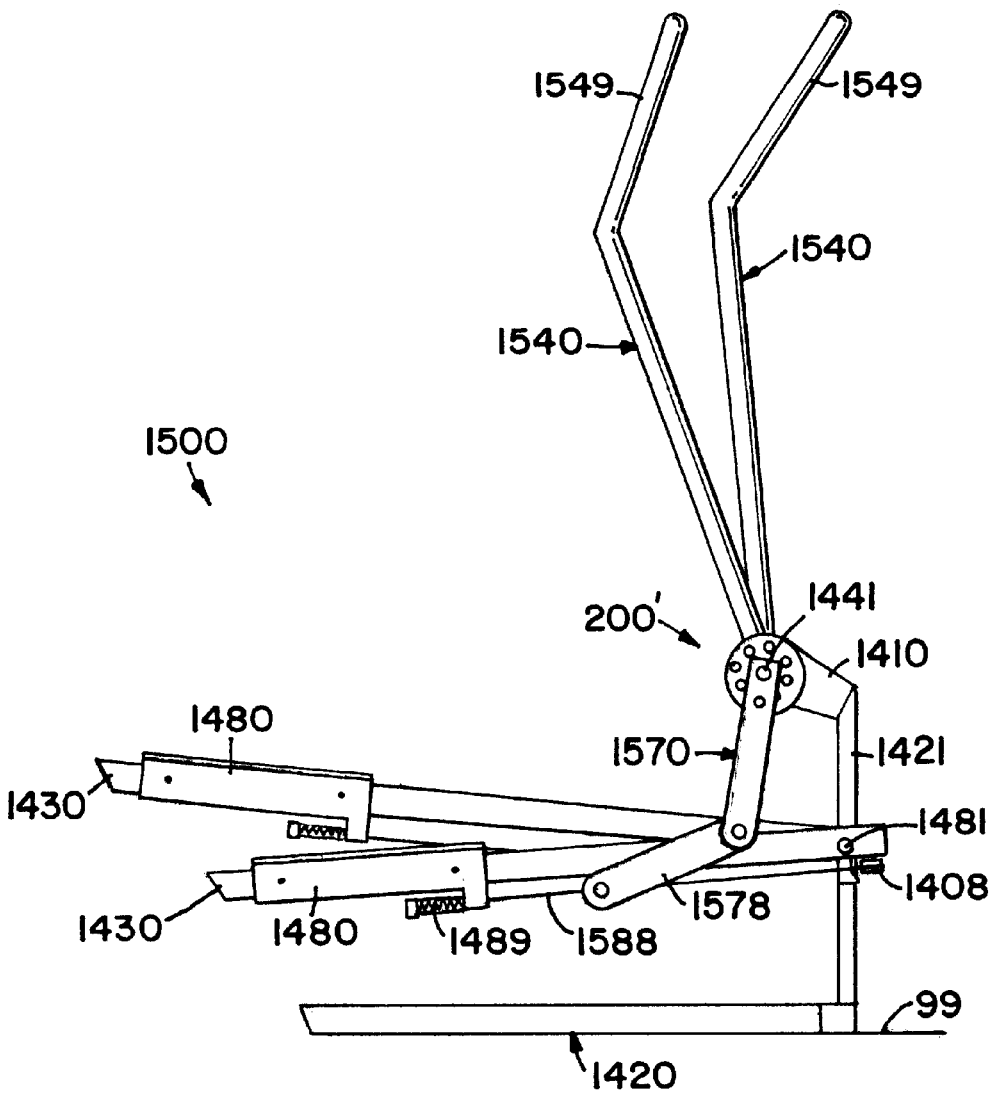
FIG. 23 is a side view of yet another exercise apparatus provided with a tri-modal exercise assembly similar to that of FIGS. 3–4.

FIG. 23 shows an exercise apparatus 1500 which is similar in many respects to the previous embodiment 1400, as suggested by the common reference numerals. Among other things, the apparatus 1500 is likewise provided with a tri-modal exercise assembly 200' similar to that shown in FIGS. 3–4. Indeed, the only significant distinction is that the intermediate links 1578 (only one of which is shown) are rotatably interconnected between respective portions of the cable 1588 and respective leg driven members 1570 (only one of which is shown). As a result, the arm driven members 1540 may be constrained to pivot back and forth as the juncture points on the cable 1548 move back and forth. As on previous embodiments, the upper ends 1549 of the arm driven members 1540 are sized and configured for grasping by a person standing on the foot supports 1480.

Figure 24:
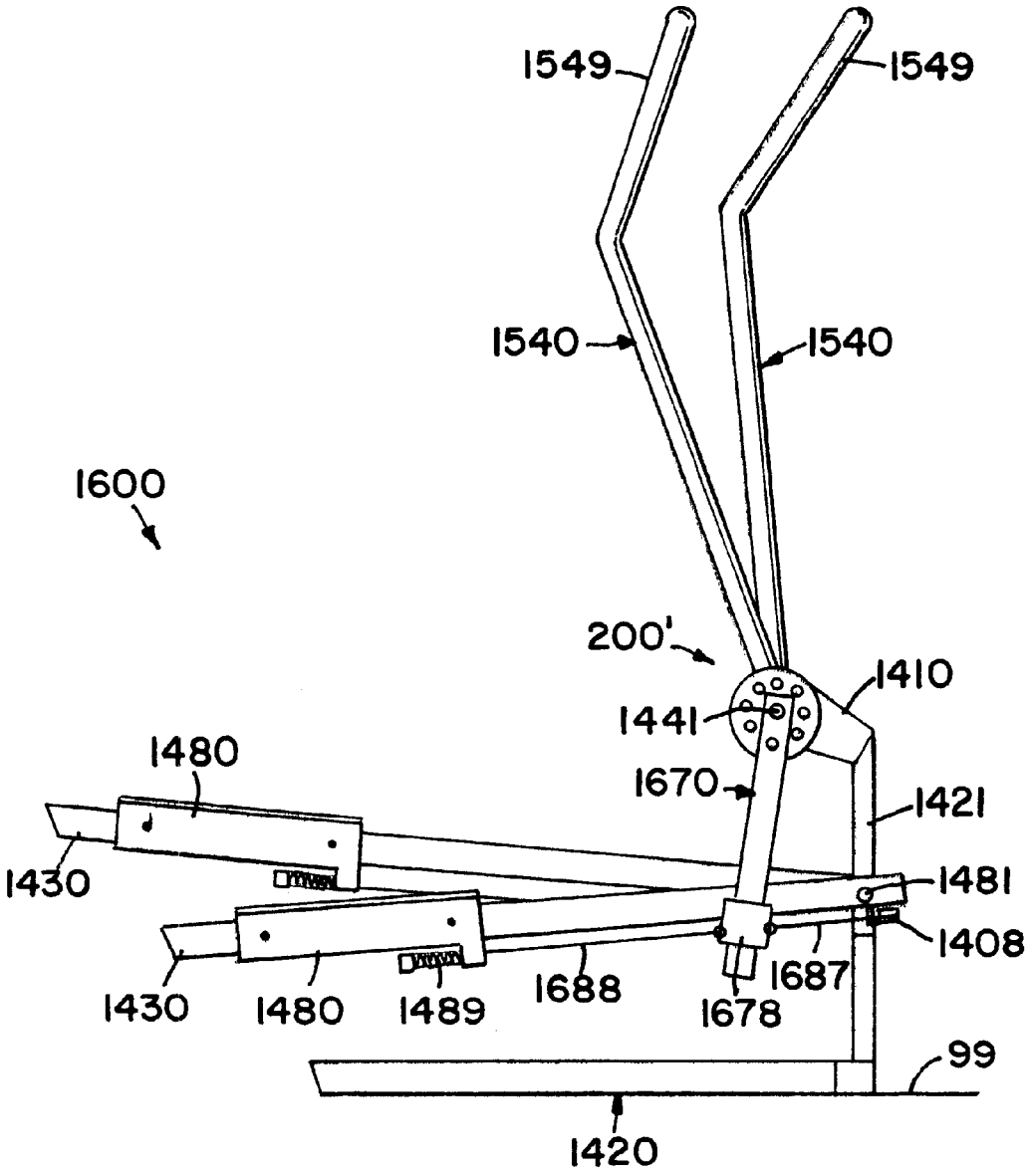
FIG. 24 is a side view of still another exercise apparatus provided with a tri-modal exercise assembly similar to that of FIGS. 3–4.

FIG. 24 shows an exercise apparatus 1600 which is similar in many respects to the previous embodiment 1500, as suggested by the common reference numerals. Among other things, the apparatus 1600 is likewise provided with a tri-modal exercise assembly 200' similar to that shown in FIGS. 3–4. Indeed, the only significant distinction is that a lower, distal portion of each leg driven member 1670 (only one of which is shown) extends into a ring 1678 which, in turn, is fixedly secured to the cord 1688. Those skilled in the art will recognize that the cord 1688 may be a single cord or three separate pieces of cord extending from one skate 1480 to the other. In any event, the arm driven members 1540 may be constrained to pivot back and forth as the rings 1678 move back and forth.

With any of the three foregoing embodiments 1400, 1500, or 1600, the orientation of the path traveled by the force supporting members 1480 may be adjusted by raising or lowering the axis 1481 relative to the floor surface 99. One such mechanism for doing so is a telescoping upright which is maintained at select heights by a detent pin arrangement (along the lines of those shown in FIGS. 10 and 21).

Figure 25:
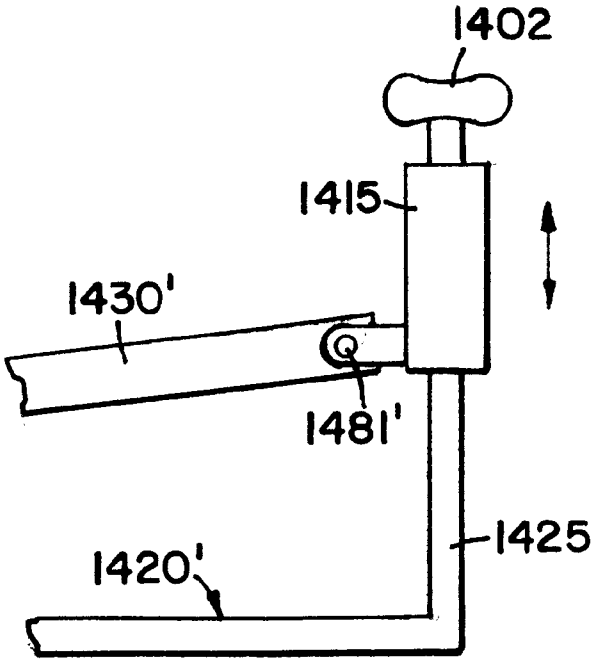
FIG. 25 is a side view of an elevation adjustment assembly suitable for use on many of the embodiments of the present invention.

Another suitable elevation adjustment mechanism is shown diagrammatically in FIG. 25, wherein a frame 1420' includes a sleeve 1415 which is movable along an upwardly extending stanchion 1425. The rails 1430' (only one of which is shown) are rotatably mounted to the sleeve 1415 to define axis 1481'. A knob 1402 is rigidly secured to a lead screw which extends through the sleeve 1415 and threads into the stanchion 130'. The knob 1402 and the sleeve 1415 are interconnected in such a manner that the knob 1402 rotates relative to the sleeve 1415, but they travel up and down together relative to the stanchion 1425 (as indicated by the arrows).

Figure 26:
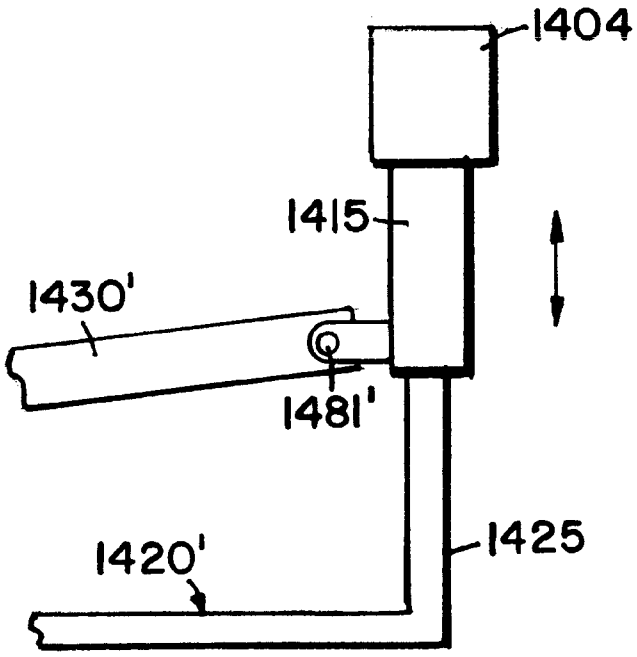
FIG. 26 is a side view of another elevation adjustment assembly suitable for use on many of the embodiments of the present invention.

Yet another suitable elevation adjustment mechanism is shown diagrammatically in FIG. 26, wherein a frame 1420' again includes a sleeve 131' which is movable along an upwardly extending stanchion 1425. The rails 1430' (only one of which is shown) are rotatably mounted to the sleeve 1415 to define the axis 1481'. An actuator 1404, such as a motor or a hydraulic drive, is rigidly secured to the sleeve 1415 and connected to a shaft which extends through the sleeve 1415 and into the stanchion 1425. The actuator 1404 selectively moves the shaft relative to the sleeve 1415, causing the actuator 1404 and the sleeve 1415 to travel up and down together relative to the stanchion 1425 (as indicated by the arrows). The actuator 1404 may operate in response to signals from a person and/or a computer controller.

Figure 27:
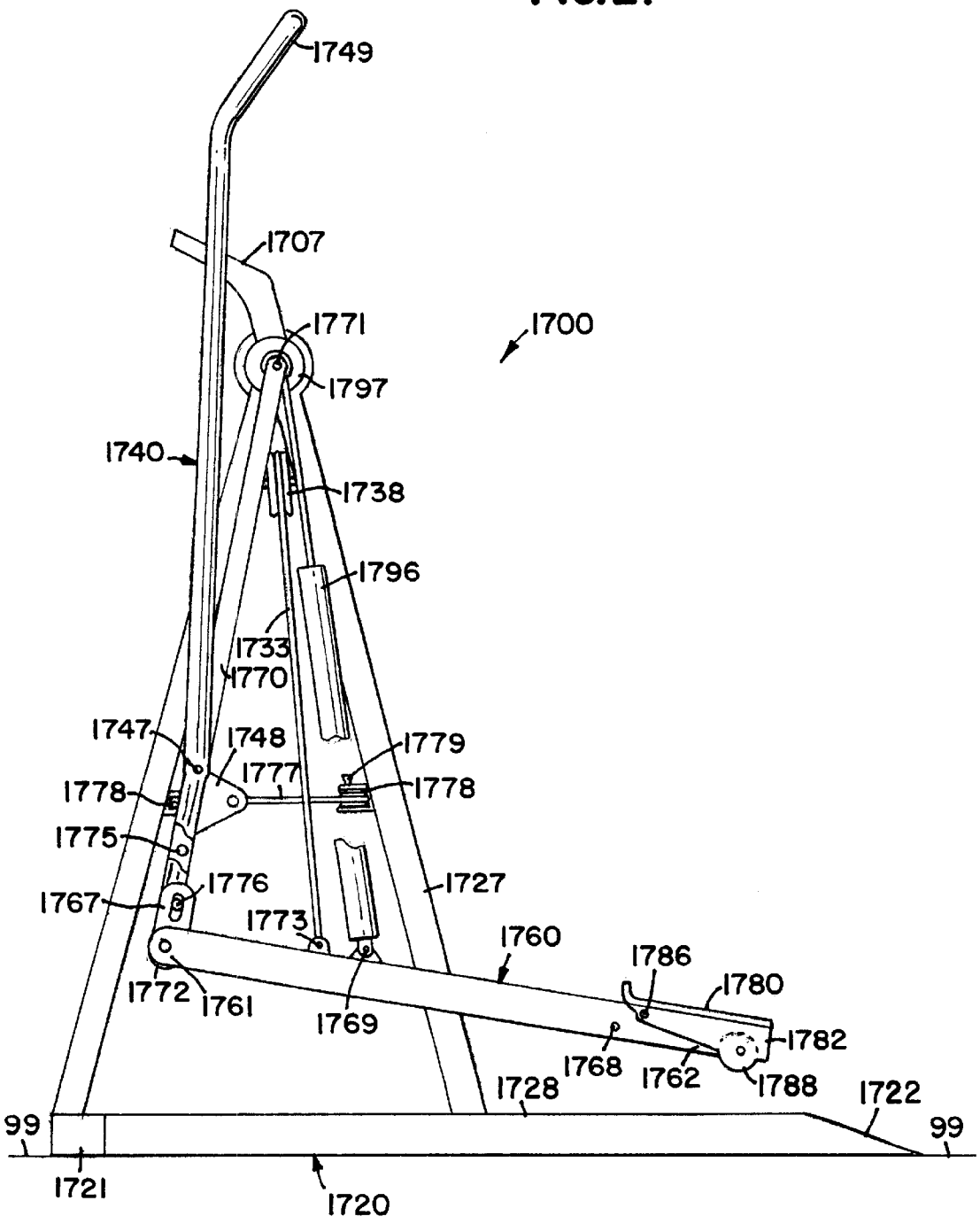
FIG. 27 is a side view of an alternative embodiment of the present invention.

As shown in FIG. 27, an exercise machine 1700 includes a frame 1720, an arm driven member 1740 movably connected to the frame 1720, and a leg exercise member 1780 movably connected to the frame 1720. Only one side of the machine 1700 is shown for ease of illustration, with the understanding that the machine 1700 is symmetrical relative to a vertical plane extending lengthwise through the frame 1720.

The frame 1720 includes a base which extends from a front end 1721 to a rear end 1722 and is designed to rest upon a horizontal floor surface 99. The rear end 1722 provides a ramp which extends between the floor surface 99 and a bearing surface 1728 on the frame 1720. An inverted V-shaped member or stanchion 1727 extends upward from the base proximate the front end 1721.

An upper end 1771 of a first leg driven member 1770 is rotatably connected to an upper end of the stanchion 1727. An opposite, lower end 1772 of the first leg driven member 1770 is rotatably connected to a forward end 1761 of a second leg driven member 1760. Both a foot support (or leg exercise member) 1780 and a roller 1788 are connected to an opposite, rearward end 1762 of the second leg driven member 1760. The foot support 1780 is secured in one of two positions relative to the second leg driven member 1760 by means of a removable fastener, such as a detent pin. The pin inserts through a hole 1786 in the foot support 1780 and either of two holes 1768 in the second leg driven member 1760. In the first position, shown in FIG. 27, the foot support 1780 lies substantially flat against the second leg driven member 1760, and in the second position, not shown, the rear end 1782 of the foot support 1780 bears against the top of the second leg driven member 1760 and maintains the foot support 1780 at an angle of approximately thirty degrees relative to the second leg driven member 1760. The roller 1788 is rotatably mounted on the second leg driven member 1760 and projects beneath the second leg driven member 1760.

A force resistance member 1796 of a type known in the art is rotatably interconnected between an intermediate portion 1769 of the second leg driven member 1760 and the upper end of the stanchion 1727. A reciprocal motion cable 1733 extends from another intermediate portion of the second leg driven member 1760 upward and about a pulley 1738 and then downward to the second leg driven member on the opposite side of the machine 1700.

A slotted member 1767 is secured to the second leg driven member 1760 proximate the forward end 1761 thereof. A cam follower 1776 is connected to a lower end of the arm driven member 1740 and protrudes into the slot formed in the slotted member 1767. An intermediate portion of the arm driven member 1740 is rotatably connected to the first leg driven member 1770, thereby defining a pivot point 1747. An upper end 1749 of the arm driven member 1740 is sized and configured for grasping by a person standing on the foot support 1780. As a result of this arrangement, the handle end 1749 is linked to movement of the first leg driven member 1770 relative to the frame 1720 and to movement of the second leg driven member 1760 relative to the first leg driven member 1770.

A bracket 1748 is rigidly secured to an intermediate portion of the first leg driven member 1770. The bracket 1748 is rigidly secured to a reciprocal motion cable 1777 which is formed into a continuous loop and routed about pulleys 1778. The force resistance member 1796 is broken away in FIG. 27 to show one of the pulleys 1778 in its entirety.

As described above, the machine 1700 accommodates upward and downward motion of the foot support 1780, as well as forward and backward motion of the foot support 1780. Any motion of one foot support 1780 results in an opposite motion of its counterpart. In other words, the foot supports 1780 are free to move in reciprocating fashion through free form paths within parallel vertical planes. Resistance to downward movement of the foot supports 1780 is provided by the force resistance mechanism 1796. Resistance to rearward movement of the foot supports 1780 may be provided by a one-way frictional brake or other force resistance mechanism 1979 interconnected between the upper end 1771 of the first leg driven member 1770 and the upper end of the stanchion 1727. An assembly 1707 may also be mounted on the upper end of the stanchion 1727 to provide an interface between the machine 1700 and a user.

From the foregoing description, those skilled in the art will recognize that the machine 1700 is suitable for performing a variety of exercise motions. For example, generally back and forth movement of the foot supports 1780 is comparable to cross-country skiing, and generally up and down movement of the foot supports 1780 is comparable to stair climbing. In this regard, the present invention also provides optional features to selectively constrain movement to a particular type of motion. For example, if a timing belt or chain is substituted for the cable 1777, then a pin or other fastener 1779 may be interconnected between either pulley 1778 and its supporting bracket to prevent rotation of the former relative to the latter and thereby limit movement of the foot supports 1780 to generally back and forth movement (about the rotational axis defined by the first leg driven member 1770 and the stanchion 1727). Moreover, a one-way clutch and flywheel assembly could be substituted for the pulley 1778. Another example of how to accomplish this motion selection feature is described with reference to FIG. 27. A portion of the arm driven member 1740 is broken away to show that a hole 1775 may be provided through each of the first leg driven members 1770 in order to selectively receive a rod which would prevent relative rotation therebetween.

Figure 28:
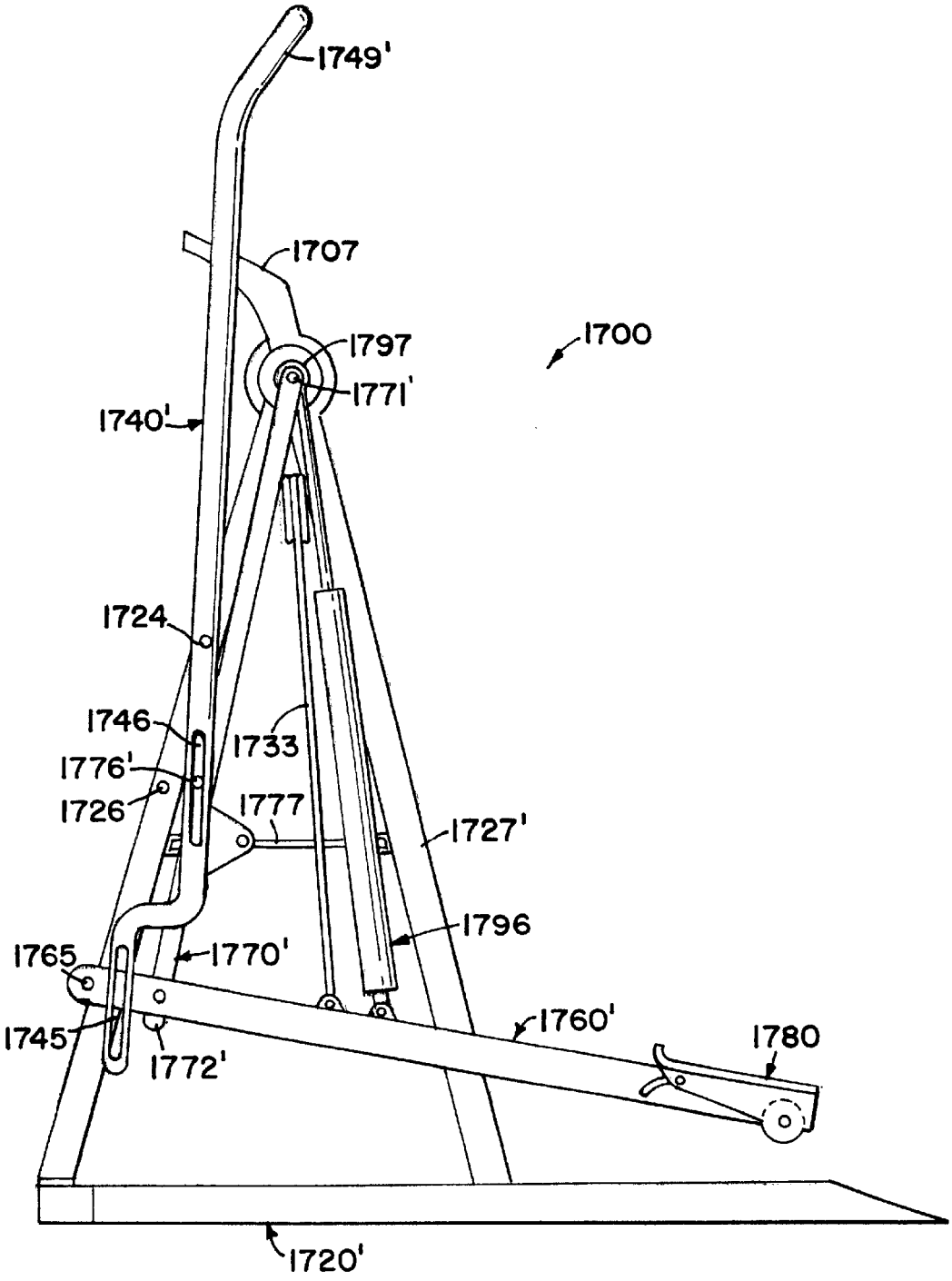
FIG. 28 is a side view of another alternative embodiment of the present invention.

As suggested by the common reference numerals, an exercise machine 1700' similar to the previous embodiment 1700 is shown in FIG. 28. An upper end 1771' of a first leg driven member 1770' is rotatably connected to an upper end of a stanchion 1727', and a lower end 1772' of the first leg driven member 1770' is rotatably connected to an intermediate portion of a second leg driven member 1760' proximate its forward end. A foot support 1780 is connected to an opposite, rearward end of the second leg driven member 1760'.

A first force resistance mechanism 1796 is interconnected between an intermediate portion of the second leg driven member 1760' and the upper end of the stanchion 1727' to resist downward movement of the forme relative to the latter. A second force resistance mechanism 1797 is interconnected between the upper end 1771' of the first leg driven member 1770' and the upper end of the stanchion 1727' to resist rearward movement of the former relative to the latter.

A first cable 1733 is interconnected between each of the second leg driven members 1760' in such a manner that one moves up as the other moves down relative to the frame 1720'. A second cable 1777 is interconnected between each of the first leg driven members 1770' in such a manner that one moves forward as the other moves rearward relative to the frame 1720'.

A significant distinction between the machine 1700' and the previous embodiment 1700 is that an intermediate portion of the arm driven member 1740' is rotatably connected to an intermediate portion of the stanchion 1727', thereby defining a pivot axis 1724. A slot 1746 is provided along an intermediate portion of the arm driven member 1740' and may be rotated into alignment with either a hole 1726 in the stanchion 1727' or a hole 1776' in the first leg driven member 1770'. A pin or other fastener may be inserted through the aligned slot 1746 and the hole 1726 in order to lock the arm driven member 1740' relative to the frame 1720'. The pin may alternatively be inserted through the aligned slot 1746 and the hole 1776' in order to link the arm driven member 1740' and the first leg driven member 1770'. Also, a slot 1745 is provided along the lower end of the arm driven member 1740' and may be rotated into alignment with a hole 1765 in the forward end of the second leg driven member 1760'. The pin may alternatively be inserted through the aligned slot 1745 and the hole 1765 in order to link the arm driven member 1740' and the second leg driven member 1760'.

This embodiment 1700' may also be seen to provide a tri-modal exercise assembly. In particular, the arm driven member 1740' may be locked against movement relative to the frame 1720', or may be linked to pivot forward about pivot axis 1724 as the first leg driven member 1770' pivots rearward relative to the frame 1720', or may be linked to pivot forward about pivot axis 1724 as the second leg driven member 1760' pivots downward relative to the frame 1720'.

Figure 29:
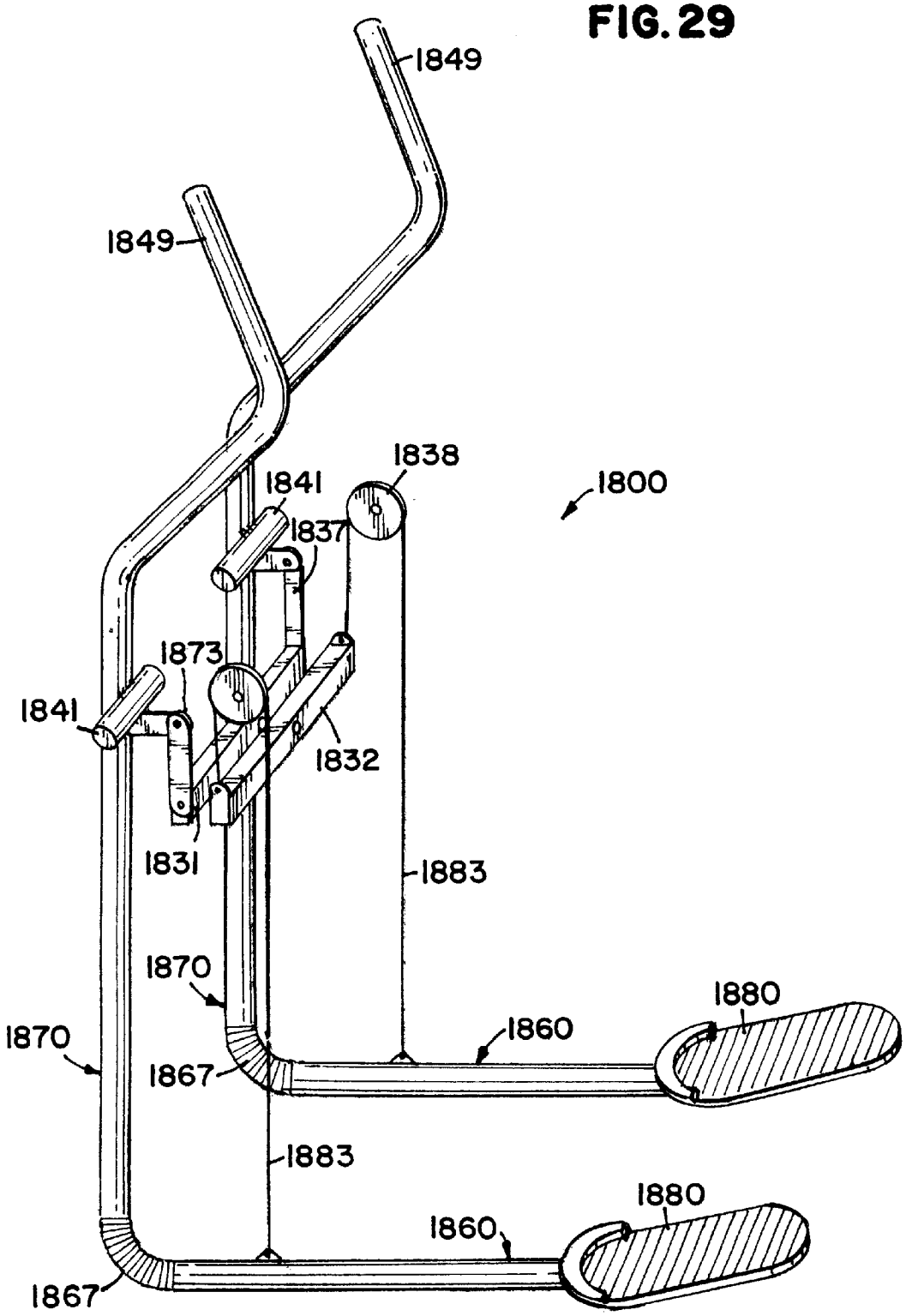
FIG. 29 is a perspective view of yet another embodiment of the present invention.

Yet another embodiment of the present invention is designated as 1800 in FIG. 29. The machine 1800 includes right and left leg driven members or vertical links 1870 having collars 1841 which are rotatably connected to a first horizontally extending shaft on a frame (not shown). Upper ends 1849 of the vertical links 1870 are sized and configured for grasping, and lower ends of the vertical links 1870 are rotatably connected to forward ends of respective left and right leg driven members or horizontal links 1860, thereby defining hinges or joints 1867. Left and right foot platforms or supports 1880 are secured to opposite, rearward ends of respective horizontal links 1860.

Figure 30:
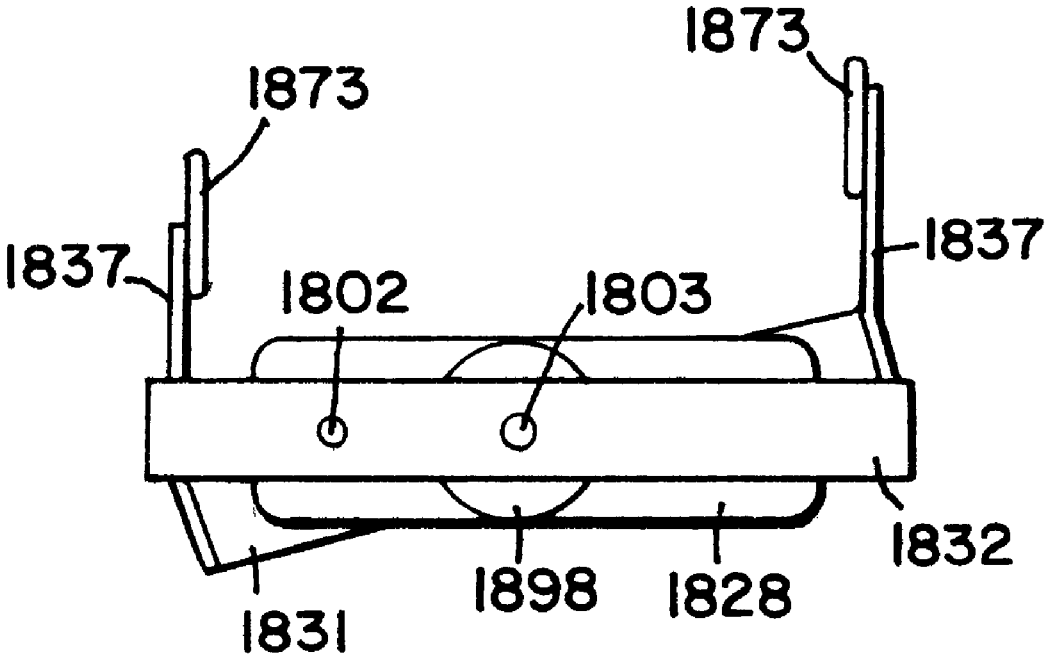
FIG. 30 is a top view of a portion of the embodiment shown in FIG. 29.

A first rocker 1831 is rotatably connected to a second horizontally extending shaft on the frame (designated as 1803 in FIG. 30), which extends perpendicular to the first horizontally extending shaft. Left and right flexible connectors 1827 are interconnected between respective ends of the first rocker 1831 and respective flanges 1873 on the left and right vertical links 1870. The arrangement is such that as the right vertical link 1870 pivots rearward relative to the frame, the right connector 1837 causes the first rocker 1831 to pivot counter-clockwise (as shown in FIG. 30), and the left connector 1837 causes the left vertical link 1870 to pivot forward relative to the frame. In other words, the first rocker 1831 provides a means for linking the vertical links 1870 to move in reciprocal fashion.

A second rocker 1832 is rotatably connected to the same shaft 1803. Left and right flexible connectors 1883 are interconnected between respective ends of the second rocker 1832 and respective intermediate portions of the left and right horizontal links 1860. Intermediate portions of the flexible connectors 1883 are routed about pulleys 1838 which are rotatably connected to the frame. The arrangement is such that as the right horizontal link 1860 pivots downward relative to the frame, the right connector 1883 causes the second rocker 1832 to pivot counter-clockwise, and the left connector 1883 causes the left horizontal link 1870 to pivot upward relative to the frame. In other words, the second rocker 1832 provides a means for linking the horizontal links 1860 to move in reciprocal fashion.

Resistance to exercise movement may be provided in any number of ways, including those shown in other embodiments described above. For example, a friction brake may be disposed between either rocker 1831 or 1832 and the frame. As shown in FIG. 30, a plate 1828 may be rigidly secured to the shaft 1803, with the rockers 1831 and 1832 disposed on opposite sides of the plate 1828. A resistance assembly 1898 may be interconnected between the plate 1828 and either or both of the rockers 1831 and 1832.

The plate 1828 may also be used to provide a means for limiting movement of the foot supports 1880 to a particular path. For example, a hole 1802 may be formed through the second rocker 1832 so as to align with a hole in the plate 1828 when the foot supports 1880 occupy like elevations relative to a support surface. A pin or other fastener may be inserted through the aligned holes to prevent pivoting of the second rocker 1832 relative to the frame and thereby limit movement of the foot supports 1880 to a path of motion centered about the first horizontally extending shaft on the frame. Similar holes may be formed through the first rocker 1831 and the plate 1828 to selectively limit movement of the foot supports 1880 to a path of motion centered about the joints 1867.

Those skilled in the art will also recognize that the machine 1800 may be readily modified to function in accordance with any of the tri-modal exercise assemblies shown in FIGS. 1–6. For example, one could simply provide the handle portions or arm driven members apart from the vertical links 1870 and rotatably mount the discrete handle portions adjacent the vertical links 1870. Overlapping ends of the rotating members may then be selectively interconnected by a pin or other connector.

Those skilled in the art will also recognize that the components of the foregoing embodiments are sized and configured to facilitate the depicted interconnections in a relatively efficient manner, and that for ease of reference in both this detailed description and the claims set forth below, the components may sometimes be described with reference to "ends" being connected to other parts. However, those skilled in the art will recognize that the present invention is not limited to links which terminate immediately beyond their points of connection with or extend directly between other parts. In other words, the term "end" should be interpreted broadly, in a manner that could include "rearward portion", for example; and in a manner wherein "rear end" could simply mean "behind an intermediate portion", for example. Moreover, the links need not extend directly between their points of connection with other parts.

Although several embodiments are described herein, those skilled in the art will undoubtedly recognize additional embodiments, modifications, and/or applications which differ from those described herein yet nonetheless fall within the scope of the present invention. Recognizing that the foregoing description sets forth only some of the numerous possible modifications and variations, the scope of the present invention is to be limited only to the extent of the claims which follow.

What is claimed is:

1. A variable motion exercise apparatus, comprising:

a frame designed to rest upon a floor surface;

a first link having three discrete connection points, wherein the first link is pivotally connected to the frame at a first of the connection points;

a second link having a first portion and a second portion, wherein the first portion is pivotally connected to the first link at a second of the connection points;

a foot support connected to the second portion of the second link; and a resistance device interconnected between the frame and the first link at a third of the connection points, wherein the resistance device provides progressively greater resistance as the foot support moves relatively closer to the floor surface.

2. The exercise apparatus of claim 1, wherein the resistance device includes a rod and a cylinder which move in telescoping fashion relative to one another.

3. The exercise apparatus of claim 2, wherein the rod and the cylinder move toward linear alignment with the first of the connection points as the foot support moves away from the floor surface.

4. The exercise apparatus of claim 1, wherein the second link has an upper distal portion sized and configured for grasping.

* * * * *